US008720214B2

(12) United States Patent
Fukuoka et al.

(10) Patent No.: US 8,720,214 B2
(45) Date of Patent: May 13, 2014

(54) ICE RINK COOLING FACILITY

(75) Inventors: Yoshinori Fukuoka, Tokyo (JP); Yoshiteru Tanaka, Tokyo (JP)

(73) Assignee: Mayekawa Mfg. Co., Ltd. (JP)

( * ) Notice: Subject to any disclaimer, the term of this patent is extended or adjusted under 35 U.S.C. 154(b) by 0 days.

(21) Appl. No.: 13/145,303

(22) PCT Filed: Dec. 28, 2010

(86) PCT No.: PCT/JP2010/073791

§ 371 (c)(1), (2), (4) Date: Oct. 10, 2012

(87) PCT Pub. No.: WO2011/129035

PCT Pub. Date: Oct. 20, 2011

(65) Prior Publication Data

US 2013/0055745 A1 Mar. 7, 2013

(30) Foreign Application Priority Data

Apr. 14, 2010 (JP) ..... 2010-093214

(51) Int. Cl.
*A63C 19/10* (2006.01)

(52) U.S. Cl.
USPC ..... 62/235; 62/260

(58) Field of Classification Search
USPC ..... 62/235, 260, 434, 335; 165/171, 175
See application file for complete search history.

(56) References Cited

U.S. PATENT DOCUMENTS 2,538,016 A * 1/1951 Kleist ..... 62/139
3,307,372 A 3/1967 Kenlson
3,491,547 A * 1/1970 Watkins ..... 62/217
3,751,935 A * 8/1973 MacCracken et al. ..... 62/75
3,878,694 A * 4/1975 Holmsten ..... 62/235
3,893,507 A * 7/1975 MacCracken et al. ..... 165/46
4,038,834 A * 8/1977 Roberts ..... 62/235
4,611,471 A * 9/1986 Ohashi ..... 62/235

(Continued)

FOREIGN PATENT DOCUMENTS

DE 1256664 B 12/1967
GB 802602 A 10/1958

(Continued)

OTHER PUBLICATIONS

Translation of JP 2008-304148 to Uchida Haruhisa.*

(Continued)

*Primary Examiner* — Mohammad M Ali

(74) *Attorney, Agent, or Firm* — Rossi, Kimms & McDowell LLP

(57) ABSTRACT

An ice rink cooling facility 100 in which a cooling-pipe bank 1 having a plurality of cooling pipes 11 is arranged at the bottom part of the ice rink 10 and $CO_2$ brine streams through the cooling pipe bank 1 so as to cool the ice rink 10, the ice rink cooling facility 100 including, but not limited to: at least one planar heat conduction member that is arranged on and over the cooling pipes 11; a $CO_2$ circulation circuit 3 that is connected to the cooling pipes 11 so that the $CO_2$ brine circulates in the $CO_2$ circulation circuit 3; an ammonia refrigerating cycle in which an ammonia refrigerant circulates; and, a cascade condenser 211 in which the heat exchange is performed between the $CO_2$ brine and the ammonia refrigerant so that the $CO_2$ brine is cooled and re-liquefied by use of the ammonia refrigerant.

13 Claims, 15 Drawing Sheets

(56) References Cited

U.S. PATENT DOCUMENTS

| | | | | |
|---|---|---|---|---|
| 6,006,826 | A * | 12/1999 | Goddard et al. | 165/179 |
| 6,170,278 | B1 * | 1/2001 | Jorgensen | 62/235 |
| 6,253,558 | B1 * | 7/2001 | Stillwell et al. | 62/66 |
| 6,477,855 | B1 * | 11/2002 | Findley et al. | 62/434 |
| 7,032,398 | B2 * | 4/2006 | Dilk et al. | 62/235 |

FOREIGN PATENT DOCUMENTS

| | | | |
|---|---|---|---|
| JP | 6219668 | A | 1/1987 |
| JP | 5021320 | A | 1/1993 |
| JP | 5279717 | A | 10/1993 |
| JP | 6337188 | A | 12/1994 |
| JP | 9303920 | A | 11/1997 |
| JP | 10110993 | A | 4/1998 |
| JP | 2000274848 | A | 10/2000 |
| JP | 2005140444 | A | 6/2005 |
| JP | 2008304148 | A | 12/2008 |

OTHER PUBLICATIONS

ISR issued Nov. 15, 2012 for corresponding PCT/JP2010/073791 (English Translation).

* cited by examiner

Fig.4 (A)
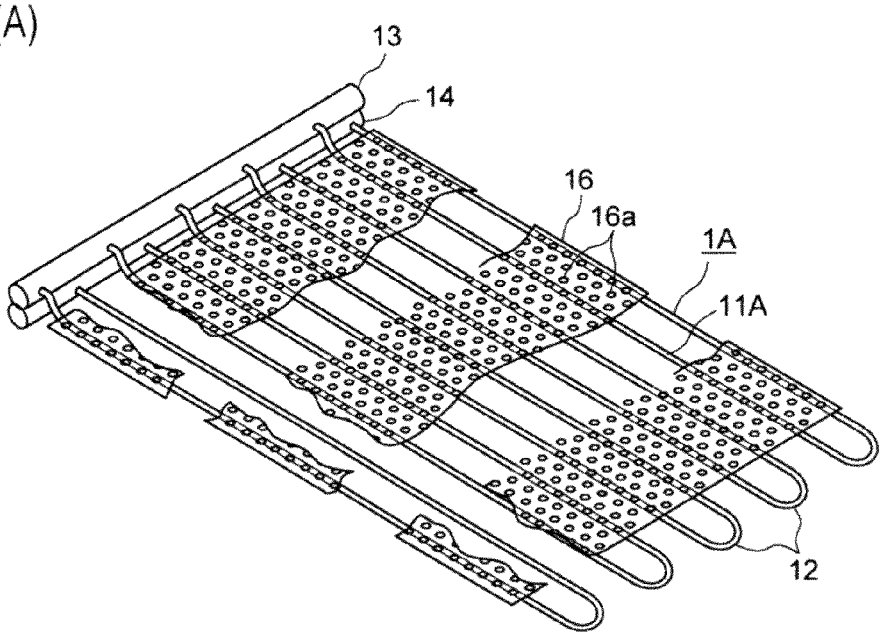
Fig.4 (B-1)
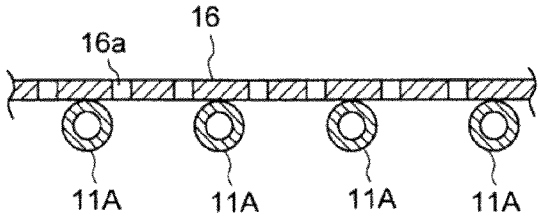
Fig.4 (B-2)
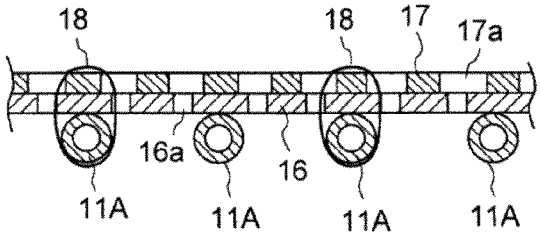

Fig.15

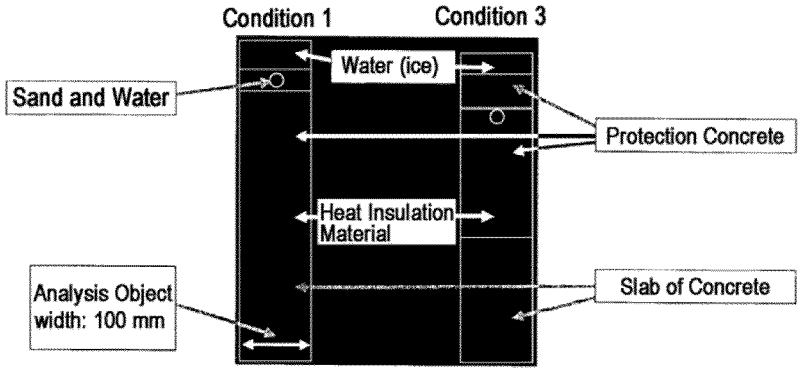

Fig.16

| | Condi.1 | Condi.2 | Condi.3 |
|---|---|---|---|
| Water Level [mm] | 40 | 30 | 30 |
| Layer of Sand and Water [mm] | 30 | Without | Without |
| Punching Metal Plate [mm] | Without | Without | 2 |
| Distance from Cooling Pipe to Water Surface [mm] | 56 | 87 | 87 |
| Cooling Pipe Temperature [°C] | −12 | | |
| Underground Temperature [°C] | 10 | | |
| Room Temperature [°C] | 15 | | |

Fig.17

| | Ice Surface | Sand and Water | Concrete | Heat Insulation Material | Punching Metal Plate (Aluminum) | Punching Metal Plate (Aluminum+Concrete Model) |
|---|---|---|---|---|---|---|
| Heat Conductivity (Heat Transfer Coefficient) | 9.84 [W/m2·K] | 1.023 [W/m·K] | 1.51 [W/m·K] | 0.03372 [W/m·K] | 222 [W/m·K] | 135.4 [W/m·K] |

Condition 1 Condition 2 Condition 3

| | Condi.1 | Condi.2 | Condi.3 |
|---|---|---|---|
| Unevenness Height [mm] | 5.9 | 0.9 | 0.2 |

Fig.20
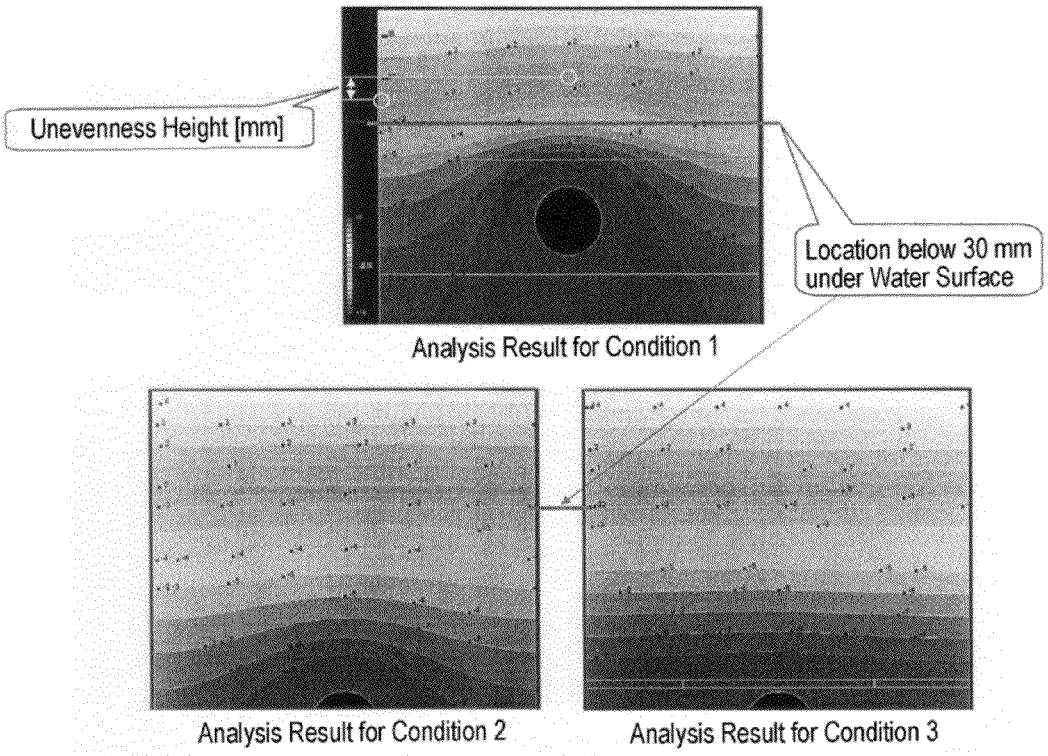
Fig.21
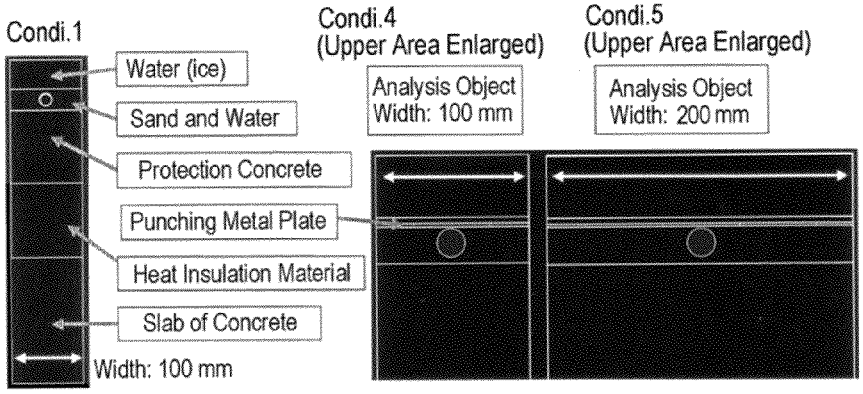
Fig.22
| | Condi.1 | Condi.2 | Condi.3 |
|---|---|---|---|
| Punching Metal Plate [mm] | Without | With | With |
| Width of Modeled Analysis Region [mm] | 100 | 100 | 200 |
| Water Level [mm] | 40 | | |
| Layer of Sand and Water [mm] | 30 | | |
| Cooling Pipe Temperature [°C] | −12 | | |
| Undeground Temperature [°C] | 10 | | |
| Room Temperature [°C] | 15 | | |

Fig.23
| | Ice Surface | Sand and Water | Concrete | Heat Insulation Material | Punching Metal Plate (Aluminum) | Punching Metal Plate (Aluminum+Concrete Model) |
|---|---|---|---|---|---|---|
| Heat Conductivity (Heat Transfer Coefficient) | 4 [W/m2·K] | 1.023 [W/m·K] | 1.51 [W/m·K] | 0.03372 [W/m·K] | 222 [W/m·K] | 135.4 [W/m·K] |
Fig.24
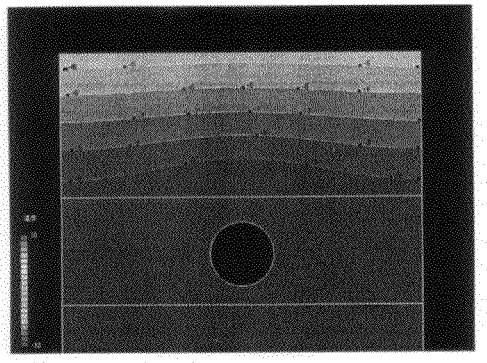
Analysis Result for Condition 1
Fig.25
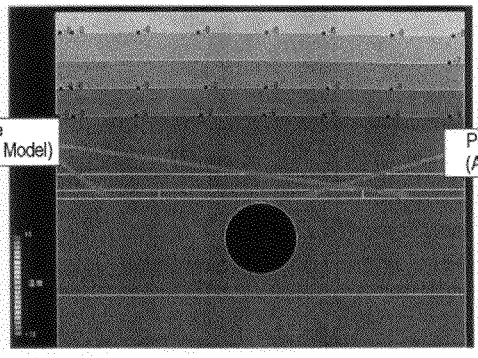
Analysis Result for Condition 4

Fig.26
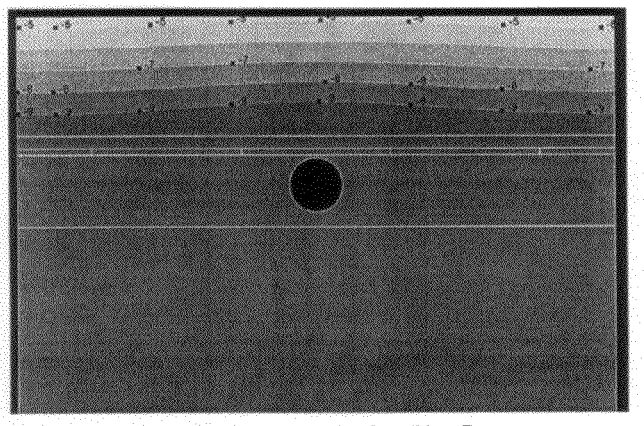
Analysis Result for Condition 5
Fig.27
| | Condi.1 | Condi.4 | Condi.5 |
|---|---|---|---|
| Unevenness Height [mm] | 5.9 | 1 | 5.7 |
Fig.28
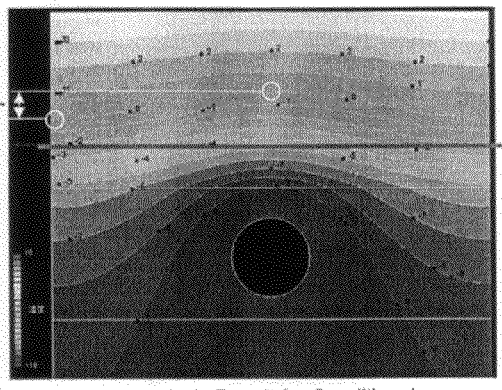
Analysis Result for Condition 1
Fig.29
| | sec | hr |
|---|---|---|
| Condi.1 | 116000 | 32.22 |
| Condi.4 | 85000 | 23.61 |
| Condi.5 | 127000 | 35.28 |

ICE RINK COOLING FACILITY

This application is a continuation of PCT International Application PCT/JP2010/073791 filed on Dec. 28, 2010, which is based on and claims priority from JP 2010-093214 filed on Apr. 14, 2010, the contents of which are herein incorporated by reference in their entirety.

BACKGROUND OF THE INVENTION

1. Field of the Invention

The present invention relates to an ice rink cooling facility that is used for cooling an ice rink having a large area to be cooled.

2. Background of the Invention

An ice rink that is utilized for ice-skating is generally annexed to a cooling facility that is used for manufacturing ice in forming the ice rink as well as for regulating the ice temperature of the ice rink. As Patent Reference 1 (JP1997-303920) discloses, a plurality of cooling pipes is constructed in the floor region as the platform of the ice rink; through the cooling pipes, the brine that is cooled by a refrigerating device such as a brine cooler is circulated so as to cool the inside of the ice rink and perform ice manufacture or ice-temperature regulation.

As described above, an ice rink generally has a large area to be cooled; thus, in order to maintain the frozen condition of ice rink, a large number of pipes have to be arranged so that a cooling pipe and the adjacent pipe thereof are placed close to each other; further, the refrigerating device has to be always driven and the brine has to be circulated.

Under the circumstances as described above, Patent Reference 2 (JP1987-19668) discloses a contrivance in which a plurality of pipes as cold reserving instruments is arranged so that the latent heat in the cold reserving instruments maintains the frozen condition. Thus, the number of the pipes arranged over the ice rink can be reduced; and, the running cost for operating the refrigerating device (the refrigerator) that accompanies the circulation of the cooling medium can be reduced.

In order to reduce the number of the cooling pipes, the cooling pipes are generally arranged along not the width direction but the longitudinal direction over the ice rink; and, in the construction example shown in Patent Reference 2, the distance between the adjacent cooling pipes can be longer than 100 mm so as to reduce the number of the pipes.

REFERENCES

Patent References

Patent Reference 1: JP1997-303920
Patent Reference 2: JP1987-19668

SUMMARY OF THE INVENTION

Subjects to be Solved

In the conventional technologies as described above, however, there are a lot of technical difficulties. For instance, in the cooling facility of Patent Reference 1, in a case where the brine of the temperature from −12 to −9° C. is fed into the cooling pipes and the temperature of the ice is maintained in the range of −5 to −1° C. by use of the sensible heat of the brine, there arises a temperature difference of approximately 2° C. between the feeding temperature and the return temperature regarding the brine; thus, it is difficult to stably keep the cooling pipe temperature at a constant level as well as to stably perform ice manufacture and ice-temperature regulation.

Further, in the cooling facility disclosed by Patent Reference 2, in a case where the frozen condition of the ice rink is maintained after the ice rink is frozen, the operation of the refrigerator can be stopped for a long time span by use of the latent heat of the cooling storage medium so as to enhance the effectiveness of the operation economy; however, there still remains a difficulty that, in freezing the rink at first, there arises an uneven distribution regarding the ice formation because of the difference between the latent heat around the cooling pipes and the latent heat around the cold reserving instruments. In addition, there is also a difficulty in regulating the ice temperature.

Further, although the number of the cooling pipes can be reduced by the manner that the distance between the adjacent pipes is set with a distance of not less than 100 mm, it becomes necessary to arrange the pipes as the cold reserving instruments that contain cooling storage medium, between the adjacent cooling pipes. Thus, cost increase is estimated in arranging the cooling pipes together with the cold reserving instruments.

In view of the difficulties as described above, the present invention aims at providing an ice rink cooling facility in which the temperature of the ice can be easily controlled and the ice rink can be evenly cooled regardless of the arrangement distance between the adjacent cooling pipes.

Means to Solve the Subjects

In order to overcome the difficulties in the conventional technologies as described above, the present invention discloses an ice rink cooling facility in which a cooling-pipe bank including, but not limited to, a plurality of cooling pipes is arranged at the bottom part of the ice rink and $CO_2$ brine streams through the cooling pipe bank so as to cool the ice rink, the ice rink cooling facility including, but not limited to:

at least one planar heat conduction member that is arranged on and over the cooling pipes;

a $CO_2$ circulation circuit that is connected to the cooling pipes so that the $CO_2$ brine circulates in the $CO_2$ circulation circuit;

an ammonia refrigerating cycle in which an ammonia refrigerant circulates; and, a cascade condenser in which the heat exchange is performed between the $CO_2$ brine and the ammonia refrigerant so that the $CO_2$ brine is cooled and re-liquefied by use of the ammonia refrigerant.

According to the above-described disclosure, the cold heat of the $CO_2$ brine streaming inside of the cooling pipes is transferred to the ice rink via the planar heat conduction member; thus, the heat transfer area can be enlarged, and the cold heat can be almost evenly transferred to the ice rink. Hence, the setting distance between the cooling pipe and the adjacent cooling pipe can be wider than the conventional pipe distance. Further, by use of the planar heat conduction member, the temperature distribution regarding the to-be-cooled region can be almost even and smooth (flat distribution); thus, the ice layer thickness regarding the ice rink can be evenly distributed.

Further, in the above-described disclosure, the $CO_2$ brine liquid that is re-liquefied by the ammonia refrigerating cycle is fed to the cooling pipes; the cold heat is generated mainly by the evaporating latent heat of the $CO_2$ brine; thus, there is little difference between the temperature of the $CO_2$ brine liquid fed through the $CO_2$ feed line and the temperature of the $CO_2$ gas-liquid brine fed through the $CO_2$ return line. Hence, the temperature distribution all over the cooling pipe bank can be evenly kept, and stable temperature regulation can be easily performed.

Moreover, in the ammonia refrigerating cycle, the evaporation temperature can be set high; thus, the high efficiency operation can be performed.

A preferable embodiment of the above-described disclosure is the ice rink cooling facility, wherein the ammonia refrigerating cycle includes, but not limited to:

a main refrigerator that is used for manufacturing the ice for the ice rink; and, an auxiliary refrigerator that is connected to the main refrigerator in parallel, and used for preventing the pressure of the $CO_2$ brine from increasing.

The reason why the above embodiment is preferable is that, when only the main refrigerator is connected to the ammonia refrigerating cycle, the pressure of the $CO_2$ brine gas increases even while the ice temperature condition is satisfactory and the operation of the main refrigerator is stopped; hence, the main refrigerator is obliged to be operated so as to limit the pressure increase. Thus, the relatively large-scale motor of the main refrigerator has to be operated and the energy for the operation is wasted.

Hence, the auxiliary refrigerator is additionally provided so as to re-liquefy the $CO_2$ brine gas; in this approach, the operation of the main refrigerator driven by the relatively large-scale motor can be dispensed with. Thus, energy saving can be achieved. Further, the auxiliary refrigerator can recover the pressurized CO2 brine gas; thus, the temperature of the $CO_2$ brine liquid in the cooling pipes of the ice rink can be reduced. As a result, the increasing speed in the ice temperature can be constrained, and the operation interval (the stop-to-restart interval) regarding the main refrigerator can be extended. Thus, further energy saving effect can be expected.

Another preferable embodiment of the above-described disclosure is the ice rink cooling facility, wherein the facility includes, but not limited to, an air-cooling type $CO_2$ re-liquefaction device that cools the $CO_2$ brine by use of the outdoor air.

The air-cooling type $CO_2$ re-liquefaction device is configured so that the outdoor-air cools the $CO_2$ brine, and circulated by natural circulation; thus, the running cost can be reduced. Furthermore, the operation with the main refrigerator and the operation with the air-cooling type $CO_2$ re-liquefaction device can be changed over into each other; thus, the driving energy can be efficiently used.

Another preferable embodiment is the ice rink cooling facility, wherein a first re-liquefaction line that includes, but not limited to, the ammonia refrigerating cycle and a second re-liquefaction line that includes air cooling type $CO_2$ re-liquefaction device are connected in parallel; and, a three-way valve is provided so that the first re-liquefaction line and the second re-liquefaction line is selectively changed over into each other, by use of the three-way valve.

According to the above, the most efficient re-liquefaction means can be selected depending on the circumstances.

Another preferable embodiment is the ice rink cooling facility, the facility including, but not limited to, a control means for changing over the three-way valve, wherein the control means control the three-way valve in a manner that the $CO_2$ brine circulates through the second re-liquefaction line in a case where the outdoor temperature is not higher than a predetermined first temperature threshold, as well as, in a manner that the $CO_2$ brine circulates through the first re-liquefaction line in a case where the outdoor temperature is higher than a predetermined second temperature threshold which is set at the first temperature threshold or higher.

In this way, in response to the outdoor temperature, when the air-cooling type $CO_2$ re-liquefaction device is applicable, the second re-liquefaction line is made use of; when the air-cooling type $CO_2$ re-liquefaction device is not applicable, the first re-liquefaction line is made use of. Thus, it is realized that the outdoor temperature condition is made the best possible use of, and the driving power expenditure is constrained to a minimal level. In addition, the second temperature threshold may be the same as the first temperature threshold.

Another preferable embodiment is the ice rink cooling facility including, but not limited to:

the planar heat conduction member is configured as a member that is different from the cooling pipes; and, the planar heat conduction member is arranged on and over the upper surface of the cooling-pipe bank so that the planar heat conduction member comes in contact with the cooling-pipe bank; and, the planar heat conduction member is provided with a plurality of holes.

In this way, since the planar heat conduction member is arranged on the upper surface of the cooling pipe bank with which the planar heat conduction member comes in contact, the floor part of the ice rink can be reinforced. It can be particularly mentioned that the reinforcing rods (or the similar structure members) that are often constructed in the conventional ice rinks for the purpose of the floor part reinforcement can be dispensed with, by arranging the planar heat conduction member according to the present disclosure.

Further, the cold heat of the $CO_2$ brine is transferred from the cooling pipe bank to the planar heat conduction member so that the ice rink is cooled via the heat conduction member; thus, the cold heat can be evenly transferred to a space between a cooling pipe and the adjacent cooling pipe thereof.

Further, in installing concrete after the cooling-pipe bank and the planar heat conduction member are arranged, the concrete can be poured through the holes, even into every corner of the space between the adjacent cooling pipes by the manner that the concrete is poured from the upper side of the planar heat conduction member; thus, the construction work regarding the cooling pipe structure can be easy. In addition, in laying concrete, the holes take a role in letting the trapped air escape.

Another preferable embodiment is the ice rink cooling facility, wherein the planar heat conduction member is a punching metal plate.

In this way, the strength of the piping structure can be enhanced.

Another preferable embodiment is the ice rink cooling facility, the facility including, but not limited to:

a pressing plate with a plurality of opening holes, the area of the opening hole being larger than the area of the hole of the planar heat conduction member, wherein the pressing plate is tied to the cooling pipes so that the planar heat conduction member is held between the pressing plate and the cooling pipes, and the planar heat conduction member is pressed toward the cooling pipes.

In this way, based on the installation of the pressing plate, the fitness (adhesion) between the planar heat conduction member and the cooling pipe is enhanced so that the heat conductivity efficiency can be maintained at a high level; in addition, the planar heat conduction member and the cooling pipe are bound with each other so that both members and can be surely fixed to each other. Particularly in a case of constructing the concrete structure, the cooling pipe can be prevented from rising from the planar heat conduction member; and, the heat conductivity can be prevented from being spoiled.

Another preferable embodiment is the ice rink cooling facility, wherein the planar heat conduction member is configured with the sidewall of the cooling pipe, the sidewall being on the upper side of the cooling pipe;

the upper side sidewall is formed in a flat planar shape, and the cooling pipe is provided with a plurality of microscopic passages through which the $CO_2$ brine streams.

According to the above, the upper sidewall of the cooling pipes forms the planar heat conduction body; the cooling pipes has a cross-section of a flat shape, and is provided with a plurality of microscopic passages. Hence, the heat conductivity area between the cooling pipe and the $CO_2$ brine can be increased, and the cooling efficiency can be enhanced.

Another preferable embodiment is the ice rink cooling facility, the facility including, but not limited to:

at least one sub-header to which a plurality of cooling pipes is connected; and, at least one main header to which a plurality of sub-headers is connected;

wherein, the cooling pipes are connected to the $CO_2$ circulation circuit via the sub-headers and the main header.

In the above-described header structure, a group of the multiple cooling pipes is not directly connected to the main header; the group of the multiple cooling pipes is connected to the main header via the sub-headers. In other words, the multiple cooling pipes are classified into a plurality of groups; each group of the cooling pipes is unitized into one component. Thus, even in a case where defective conditions are encountered in some of the cooling pipes, it is not necessary to stop the brine flow in all the cooling pipes; and, the brine flow of only the cooling pipe unit in defective condition may be stopped. In this way, the operation of the refrigerating facility can be continued. In addition, only the cooling pipe unit (group) in defective condition may be replaced with new one. Accordingly, the maintenance or repair work can be easily performed.

Further, the cooling pipes are generally jointed to the headers by welding; when a lot of cooling pipes is welded to the main header, the main header may be often bent due to the superposing of welding deformation. According to the above-described structure, the cooling pipes are welded to the sub-header, the length of the sub-header being shorter than the length of the main header. Thus, the welding deformation can be constrained to a small level. Further, since the cooling pipes are connected to the sub-header, the cooling pipes are easily constructed.

Another preferable embodiment is the ice rink cooling facility, the facility including, but not limited to, an air duct at least along the circumference of the ice rink, wherein the cooling air fed through the air duct is spouted upward from the air duct so as to form an air curtain.

The height of the air curtain formed along the circumference of the ice rink is limited to a certain level from the floor part of the ice rink; and, the air curtain does not affect the audience vision. Accordingly, the above-described contrivance is applicable to the ice rink such as a curling use ice rink where no special fence along the circumference of the ice rink is placed.

Effects of the Invention

According to the above-described disclosure of the present invention, the cold heat of the $CO_2$ brine streaming inside of the cooling pipes is transferred to the ice rink via the planar heat conduction member; thus, the heat transfer area can be enlarged, and the cold heat can be almost evenly transferred to the ice rink. Hence, the setting distance between the cooling pipe and the adjacent cooling pipe can be wider than the conventional pipe distance. Further, by use of the planar heat conduction member, the temperature distribution regarding the to-be-cooled region can be almost even and smooth (flat distribution); thus, the ice layer thickness regarding the ice rink can be evenly distributed.

Further, in the above-described disclosure, the $CO_2$ brine liquid that is re-liquefied by the ammonia refrigerating cycle is fed to the cooling pipes; the cold heat is generated mainly by the evaporating latent heat of the $CO_2$ brine; thus, there is little difference between the temperature of the $CO_2$ brine liquid fed through the $CO_2$ feed line and the temperature of the $CO_2$ gas-liquid brine fed through the $CO_2$ return line. Hence, the temperature distribution all over the cooling pipe bank can be evenly kept, and stable temperature regulation can be easily performed.

Moreover, in the ammonia refrigerating cycle, the evaporation temperature can be set high; thus, the high efficiency operation can be performed.

BRIEF DESCRIPTION OF THE DRAWINGS

The present invention will now be described in greater detail with reference to the modes, preferred embodiments and application examples of the invention, and the accompanying drawings, wherein:

FIGS. 4(A), 4(B-1) and 4(B-2) show a first configuration example regarding the cooling pipes for cooling the ice rink;

FIG. 4(A) shows a perspective view;

FIG. 4(B-1) shows a cross-section view;

FIG. 4(B-2) shows a cross section view regarding another configuration example (a variation of the first configuration example);

Figure 6:
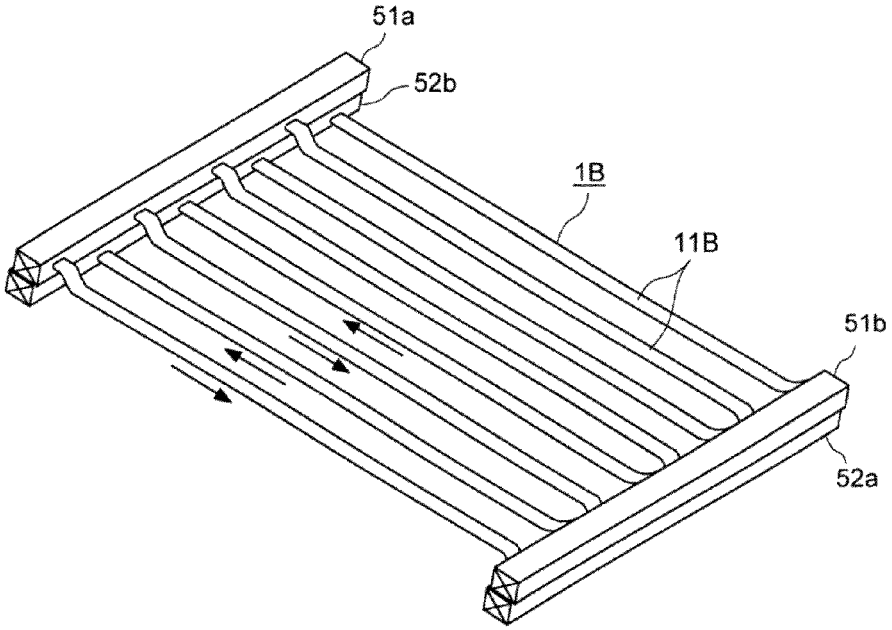
FIG. 6 shows a perspective view of a second configuration example regarding the ice rink cooling pipe structure.
Figure 7:
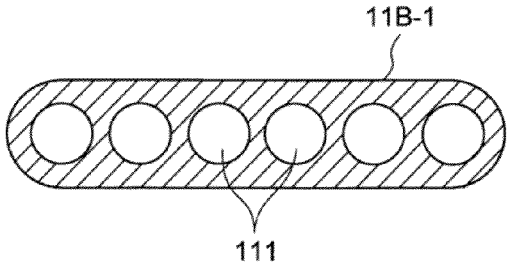
Figure 7:
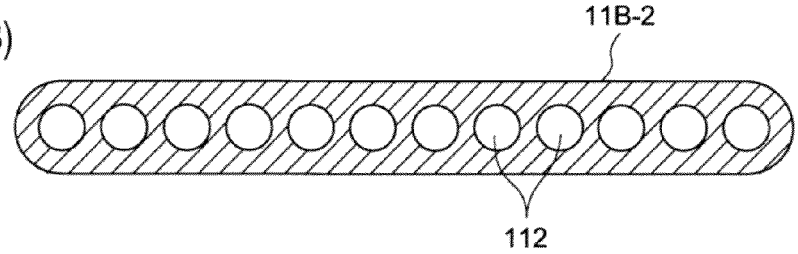
Figure 7:
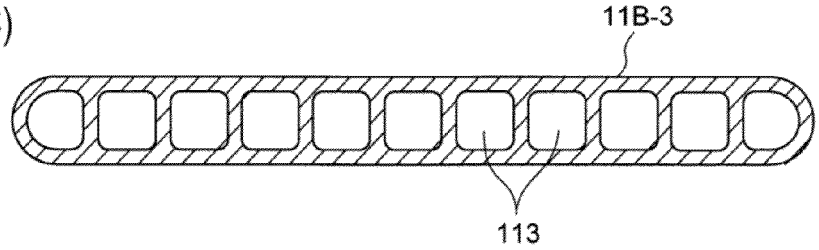
Figure 8:
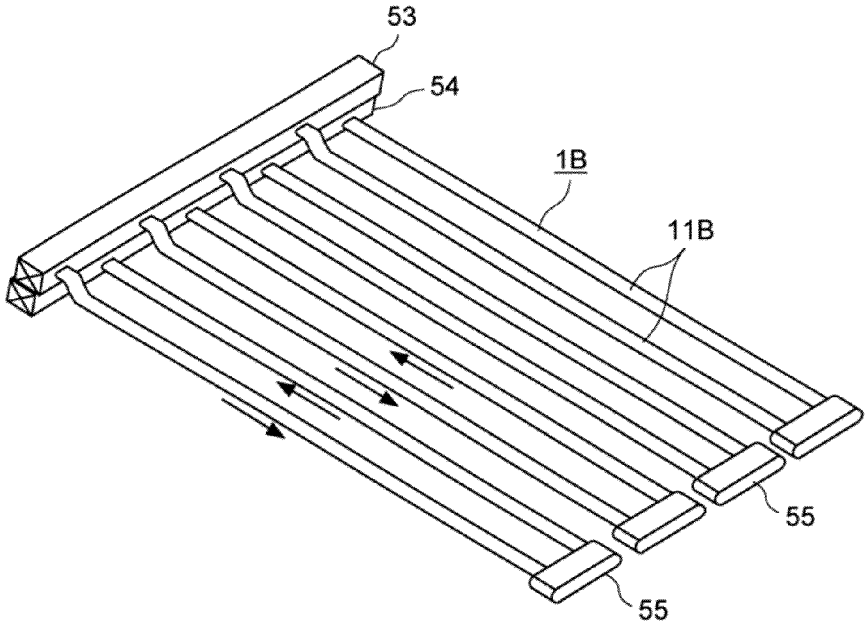
Figure 9:
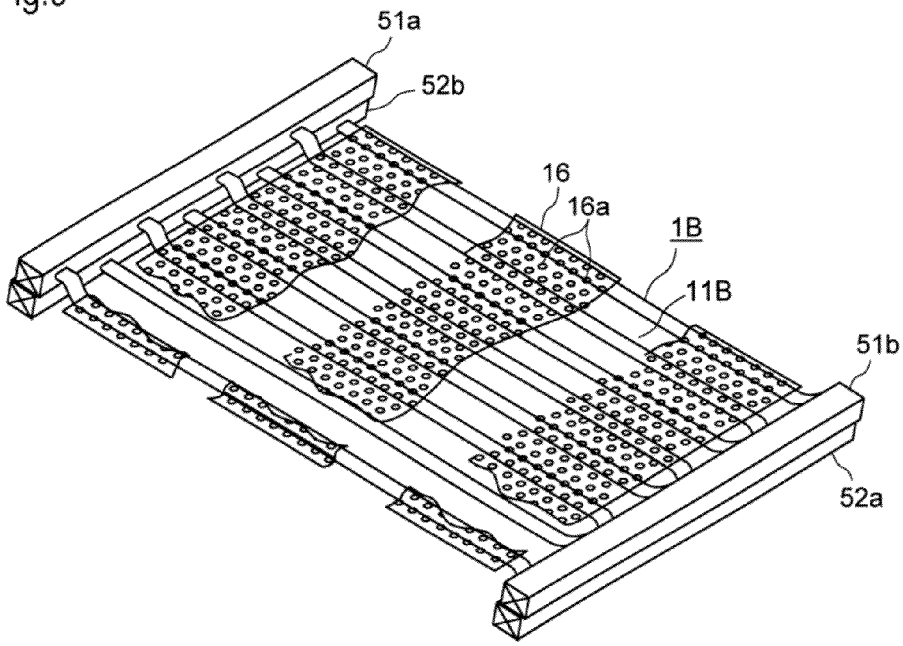
Figure 10:
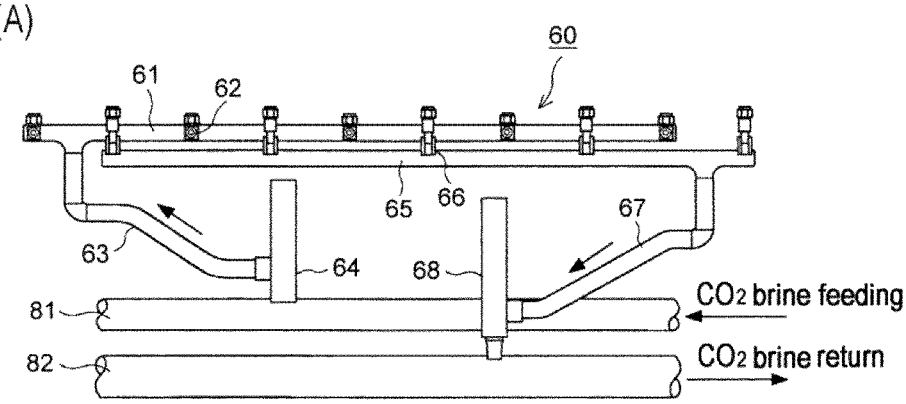
Figure 10:
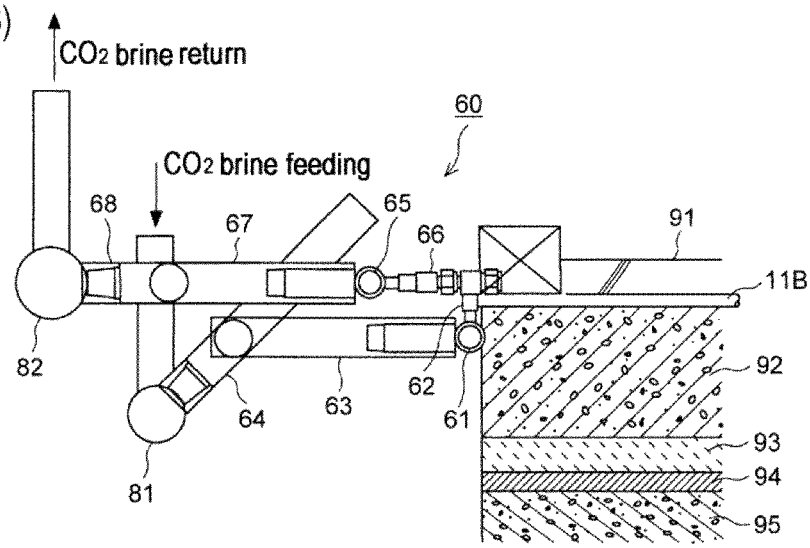
Figure 11:
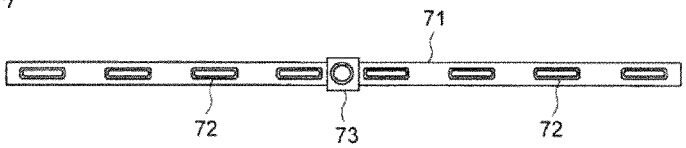
Figure 11B:
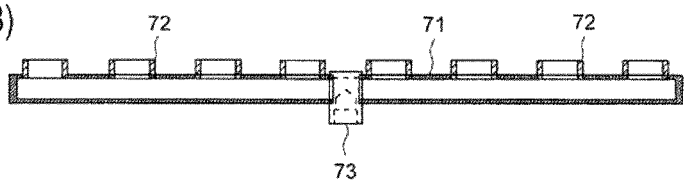
Figure 12:
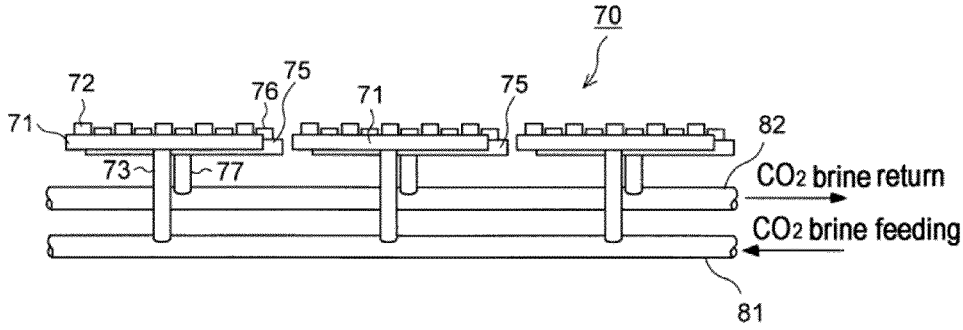
Figure 13:
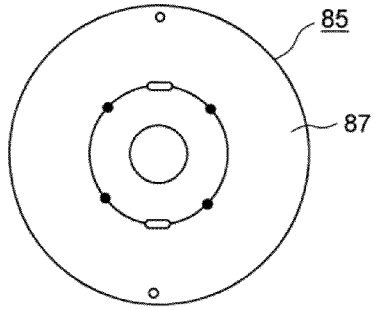
Figure 13:
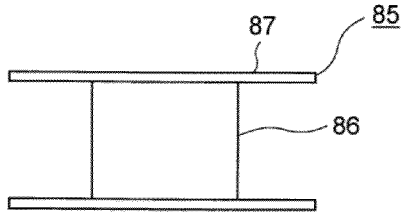
Figure 14:
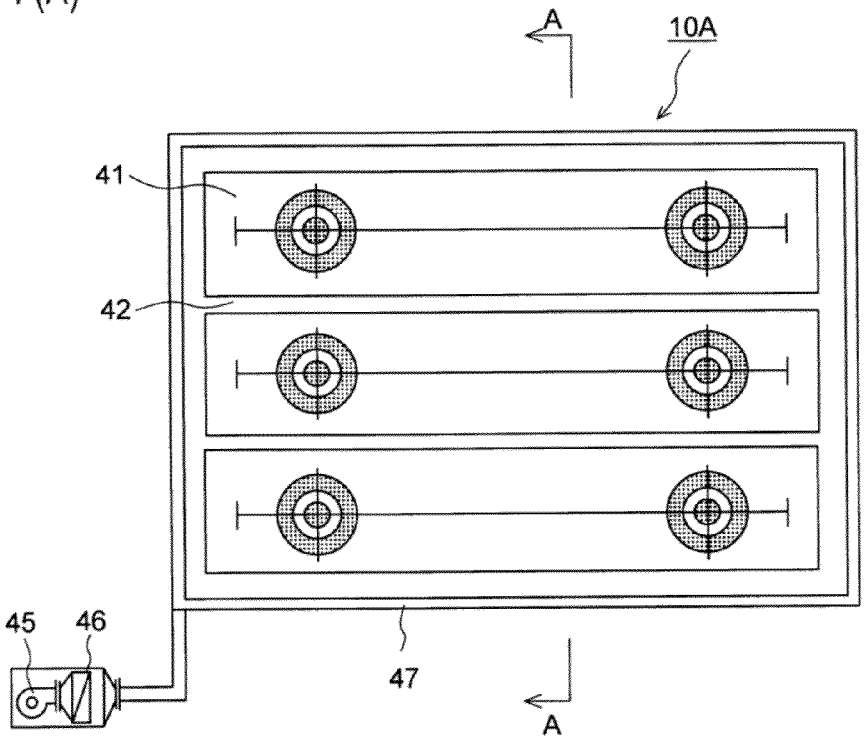
Figure 14:
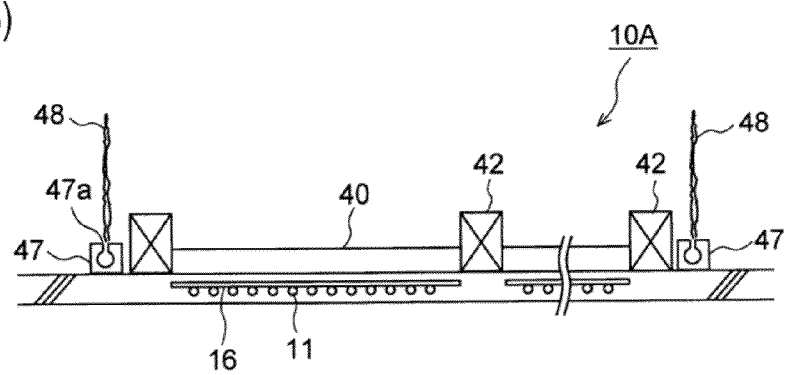
Figures 18, 19:
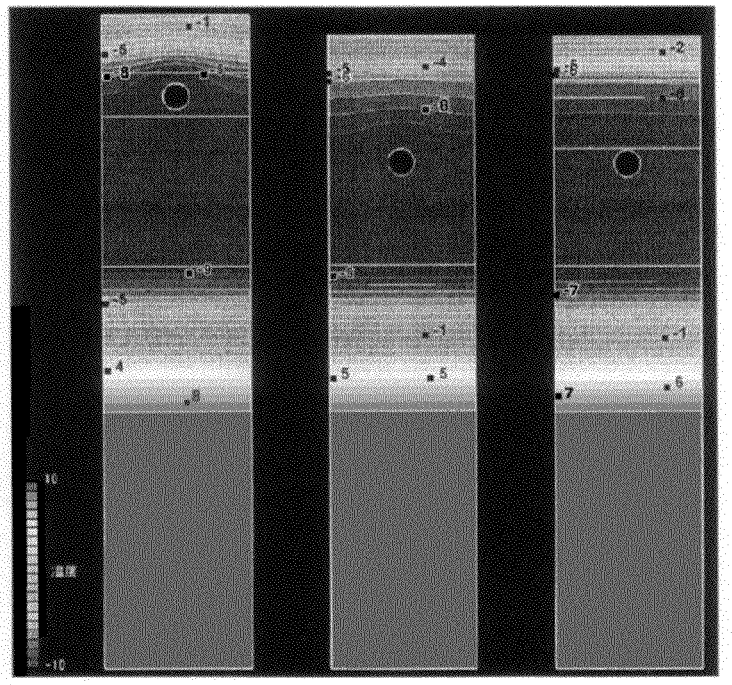

each of FIGS. 7(A), 7(B) and 7(C) shows a cross-section of a cooling pipe provided with a micro-channels structure;

FIG. 8 shows a perspective view regarding a variation of the second configuration example in relation to the ice rink cooling pipe structure depicted in FIG. 6;

FIG. 9 shows a perspective view regarding another variation of the second configuration example in relation to the ice rink cooling pipe structure depicted in FIG. 6;

FIGS. 10(A) and 10(B) show a first configuration example of a header structure regarding the ice rink cooling pipes;

FIGS. 10(A) and 10(B) show the plan view and a side view respectively;

FIGS. 11(A) and 11(B) show a second configuration example of a header structure regarding the ice rink cooling pipes;

FIGS. 11(A) and 11(B) show a plan view and a side view respectively;

FIG. 12 shows the whole outline of the second configuration example of the header structure regarding the ice rink cooling pipes;

FIGS. 13(A) and 13(B) show a bobbin for the cooling pipe;

FIGS. 13(A) and 13(B) show a plan view and a side view respectively;

FIGS. 14(A) and 14(B) show an ice rink for curling;

FIGS. 14(A) and 14(B) show a plan view and a side view respectively;

FIG. 15 shows an outline of the analysis model regarding a first application example;

FIG. 16 shows a table of the analysis conditions regarding the first application example;

FIG. 17 shows a table that describes the heat conductivity of each layer in the first application example;

FIG. 18 shows the analysis results regarding the steady states in the first application example, each steady state being in response to each analysis condition;

FIG. 19 shows the analysis results regarding the unevenness heights in the first application example, each unevenness height being in response to each analysis condition;

FIG. 20 shows the analysis results regarding the non-steady states in the first application example, each non-steady analysis result being in response to each analysis condition;

FIG. 21 shows an outline of the analysis model regarding a second application example;

FIG. 22 shows a table of the analysis conditions regarding the second example;

FIG. 23 shows a table that describes the heat conductivity of each layer in the second application example;

FIG. 24 shows the analysis result regarding the steady state in response to the first condition in the second application example;

FIG. 25 shows the analysis result regarding the steady state in response to the fourth condition in the second application example;

FIG. 26 shows the analysis result regarding the steady state in response to the fifth condition in the second application example;

FIG. 27 shows the analysis results regarding the unevenness heights in the second application example, each unevenness height being in response to each analysis condition;

FIG. 28 shows the analysis result regarding the non-steady state in response to the first condition in the second application example;

FIG. 29 shows a table in which the time span needed for an end point of the ice rink to reach −4° C. in response to each condition is described.

DETAILED DESCRIPTION OF THE BEST MODE, THE PREFERRED EMBODIMENTS, AND THE APPLICATION EXAMPLES

Hereafter, the present invention will be described in detail with reference to the modes, embodiments or application examples shown in the figures. However, the dimensions, materials, shape, the relative placement and so on of a component described in these modes, embodiments or application examples shall not be construed as limiting the scope of the invention thereto, unless especially specific mention is made.

(First Mode of Ice Rink Cooling Facility)

Figure 1:
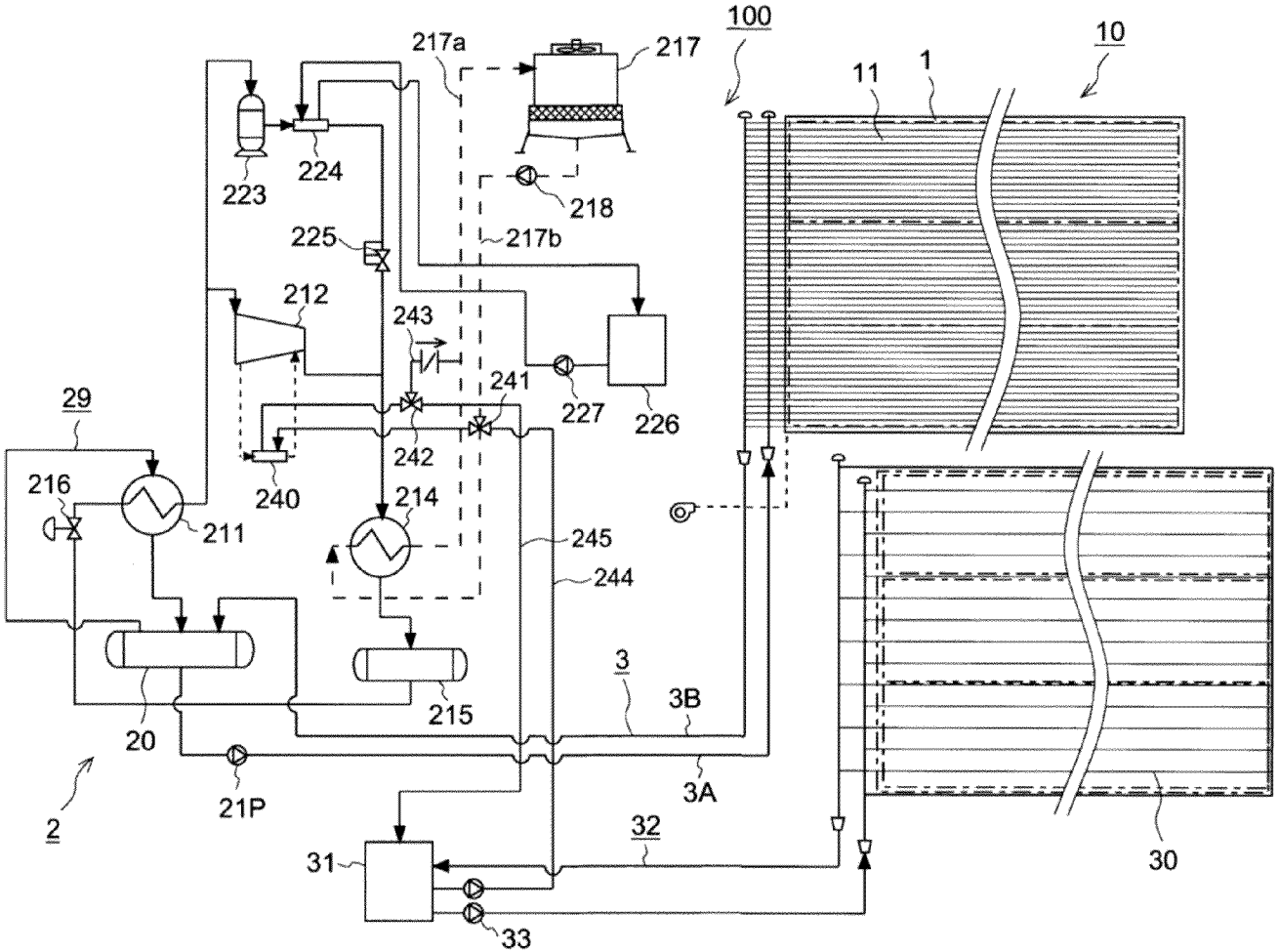
FIG. 1 shows the whole outline of the ice rink cooling facility according to a first mode of the present invention.

FIG. 1 shows the whole outline of the ice rink cooling facility according to a first mode of the present invention.

An ice rink cooling facility 100 according to the first mode chiefly includes (but not limited to):

a cooling-pipe bank 1 including, but not limited to, a plurality of cooling pipes 11; and, a refrigerating device 2 provided with a $CO_2$ circulation circuit 3 and an ammonia refrigerating cycle. In addition, an ice rink 10 to which the present mode can be applied generally covers the ice rink for ice skating, curling, ice hockey and so on.

A plurality of cooling pipes 11 included in the cooling-pipe bank 1 is arranged on the bottom (the floor) of the ice rink 10; the cooling-pipe bank 1 is provided with at least one planar heat conduction member on the upper side of the cooling pipes 11 in which $CO_2$ liquid brine as cooling medium streams. By use of the evaporating latent heat of the $CO_2$ liquid brine streaming inside of the cooling-pipe bank 1, the ice rink 10 is cooled, the water on the bottom of the ice rink 10 is frozen so as to form ice or the temperature control regarding the frozen ice is performed. As for the cooling-pipe bank 1 and the planar heat conduction member, the concrete explanation will be given later.

The refrigerating device 2 that is connected to the cooling pipes 11 includes, but not limited to:

a $CO_2$ circulation circuit 3 in which the $CO_2$ brine circulates; an ammonia refrigerating cycle that includes, but not limited to, a main refrigerator 212, and an auxiliary refrigerator 223, the $CO_2$ brine circulating in the $CO_2$ circulation circuit 3; and, a cascade condenser 211 that cools and re-liquefies $CO_2$ brine by means of the heat exchange between the $CO_2$ brine and the ammonia refrigerant.

The $CO_2$ circulation circuit 3 is configured with: a $CO_2$ feed line 3A for feeding the $CO_2$ liquid brine toward the cooling-pipe bank 1 from a $CO_2$ receiver 20, and a $CO_2$ return line 3B for feeding-back the $CO_2$ brine of a gas-liquid phase toward the $CO_2$ receiver 20, the gas-liquid phase $CO_2$ brine being discharged from the cooling-pipe bank 1. Further, on a part way of the $CO_2$ feed line 3A, a $CO_2$ liquid pump 21P is provided.

To the lower part of the $CO_2$ receiver 20, the $CO_2$ feed line 3A is connected so that the $CO_2$ liquid brine is supplied to the cooling pipe bank 1; while the $CO_2$ brine passes through the cooling pipe bank 1, a part of $CO_2$ brine changes into the gas-liquid phase $CO_2$ brine; and, the gas-liquid phase $CO_2$ brine returns to the $CO_2$ receiver 20 via the $CO_2$ return line 3B that is connected to an upper part of the $CO_2$ receiver 20.

Further, an upper part of the $CO_2$ receiver 20 communicates with a re-liquefaction line 29 through which $CO_2$ gas brine from the $CO_2$ receiver 20 is re-liquefied and returns to the $CO_2$ receiver 20.

On a part way of the re-liquefaction line 29, a cascade condenser 211 is provided; the $CO_2$ gas brine from the $CO_2$ receiver 20 is fed to the cascade condenser 211 and is cooled in the cascade condenser 211, by the ammonia refrigerant; and, the cooled $CO_2$ brine returns to $CO_2$ receiver 20, through the line 29.

The main refrigerator 212 and the auxiliary refrigerator 223 connect the cascade condenser 211 and a condenser 214 on a circuit of the ammonia refrigerating cycle so that parallel connection lines are formed from the cascade condenser 211 to the condenser 214; the operation of the main refrigerator 212 can be switched over to the operation of the auxiliary refrigerator 223 or vice versa so that the ammonia refrigerant can be cooled by one of the refrigerators 212 and 223.

To be more specific, the ammonia refrigerating cycle is formed as a closed circuit on which the cascade condenser 211, the main refrigerator 212 that is a compressor, the auxiliary refrigerator 223 that is also a compressor, the condenser 214, a high-pressure ammonia receiver 215 and an expansion valve 216 are arranged in order.

The main refrigerator 212 or the auxiliary refrigerator 223 compresses the ammonia refrigerant gas that is evaporated by the heat of the $CO_2$ brine at the cascade condenser 211; and, the pressure and the temperature of the ammonia refrigerant gas are enhanced. Then, the ammonia refrigerant gas of a high temperature and a high pressure is cooled and condensed into a liquefied state at the condenser 214; and, the liquefied ammonia refrigerant is reserved in the high-pressure ammonia receiver 215. The ammonia refrigerant liquid reserved in the high-pressure ammonia receiver 215 is appropriately fed to the expansion valve 216 so as to expand (be depressurized); the depressurized ammonia refrigerant liquid is fed to the cascade condenser 211 so as to cool the $CO_2$ brine gas. In addition, through the condenser 214, a pump 218 circulates the warm brine that is cooled in a hermetically sealed cooling tower 217.

The above-described main refrigerator 212 is a refrigerator that is used mainly for forming the ice of the ice rink 10; and, the main refrigerator 212 can withstand a high refrigerating load. In addition, the main refrigerator 212 is also used for keeping the cold condition of the ice rink when the ice rink begins being used.

On the other hand, the auxiliary refrigerator 223 is operated when the operation of the main refrigerator 212 is stopped; the auxiliary refrigerator 223 is used mainly for preventing the pressure of the $CO_2$ brine from increasing out of a normal range; and, the auxiliary refrigerator 223 can cope with a low refrigerating load. On the gas-discharge line regarding the gas compressed by the auxiliary refrigerator, a high pressure regulating valve 225 is provided Further, the change-over from the main refrigerator operation to the auxiliary refrigerator operation or vice versa may be performed on the basis of an ice temperature regarding the ice rink 10; thereby, the ice temperature is continuously detected by a temperature detecting means; in a case where the ice temperature regarding the ice rink 10 is not lower than a prescribed change-over threshold temperature, the main refrigerator 212 is operated and the auxiliary refrigerator 223 is stopped; and, in a case where the ice temperature regarding the ice rink 10 is lower than the prescribed change-over threshold temperature, the main refrigerator 212 is stopped and the auxiliary refrigerator 223 is operated.

Further, it is preferable that a plurality of heating pipes 30 are constructed on the under-floor ground under the ice rink 10; the heating pipes 30 are arranged so that the low temperature heat (cold heat) from the cooling-pipe bank 1 does not freeze the under-floor ground and the under-floor ground is prevented from rising-up (frost heaving prevention). On the other hand, the warm brine is heated by the waste heat of the main refrigerator 212. The heated warm brine streams through the heating pipes 30; the warm brine is reserved in a warm brine tank 31, and circulates through the heating pipes 30. The warm brine that is reserved in the warm brine tank 31 is fed to the heating pipes 30 via a warm brine circulation line 32, by means of a warm brine circulation pump 33; and, the warm brine that is fed to the heating pipes 30 is returned to the warm brine tank 31, via the warm brine circulation line 32.

In the next place, how the ice rink cooling facility 100 configured as described above works is explained.

In forming the ice of the ice rink 10, in the ammonia refrigerating cycle, the main refrigerator 212 compresses the ammonia refrigerant gas that is evaporated by the heat of the CO2 brine at the cascade condenser 211; and, the pressure and the temperature of the ammonia refrigerant gas are enhanced. Then, the ammonia refrigerant gas of a high temperature and a high pressure is cooled and condensed into a liquefied state at the condenser 214. The liquefied ammonia refrigerant is fed to the expansion valve 216 via the high-pressure ammonia receiver 215, so as to expand (be depressurized) at the expansion valve; the depressurized ammonia refrigerant liquid is fed to the cascade condenser 211 so as to cool the $CO_2$ brine.

The $CO_2$ brine liquid that is cooled and re-liquefied by the ammonia refrigerant at the cascade condenser 211 is reserved in the $CO_2$ receiver 20. The $CO_2$ brine liquid reserved in the $CO_2$ receiver 20 in a temperature of approximately −8° C. is fed to the cooling-pipe bank 1 arranged in the ice rink 10, by the $CO_2$ liquid pump 21P, via the $CO_2$ feed line 3A. The $CO_2$ brine liquid fed to the cooling-pipe bank 1 cools the ice of the ice rink; and, a part of the $CO_2$ brine liquid is vaporized. In other words, the $CO_2$ brine liquid changes into a $CO_2$ brine in a gas-liquid phase in a temperature of approximately −8° C.; and, the $CO_2$ brine in the gas-liquid phase is returned to the $CO_2$ receiver 20, via the $CO_2$ return line 3B.

On the other hand, in order to maintain the ice condition of the ice rink after the rink ice is formed, the ammonia refrigerant gas in the ammonia refrigerating cycle is compressed by the auxiliary refrigerator 223; as is the case with the above-described ice manufacture, the $CO_2$ brine is re-liquefied and the re-liquefied $CO_2$ brine is fed to the cooling pipe bank 1 so as to cool the cooling pipe bank and maintain the ice temperature.

According to the first mode as described above, the cooling pipe bank 1 cool the ice of the rink by use of the evaporating latent heat of the $CO_2$ brine liquid; thus, there is little difference between the temperature of the $CO_2$ brine liquid streaming through the $CO_2$ feed line 3A and the temperature of the $CO_2$ gas-liquid brine streaming through the $CO_2$ return line 3B. Hence, the temperature distribution all over the cooling pipe bank 1 can be evenly kept, and stable temperature regulation can be easily performed.

Further, the evaporation temperature as to the ammonia refrigerating cycle can be set at a high level; and, the operation with high efficiency can be realized.

Further, in forming the ice of the ice rink 10, the main refrigerator 212 is operated; except for the case of ice forming, the auxiliary refrigerator 223 can be operated instead of the main refrigerator. Thus, energy saving can be achieved.

Particularly when the operation with the main refrigerator 212 and the operation with the auxiliary refrigerator 223 are changed over into each other based on the ice temperature condition regarding the ice rink, further effects regarding energy saving can be obtained. The reason is that, when only the main refrigerator 212 configures the ammonia refrigerating cycle (without the auxiliary refrigerator), the pressure of the $CO_2$ brine gas increases even while the ice temperature condition is satisfactory and the operation of the main refrigerator 212 is stopped; hence, the main refrigerator 212 is obliged to be operated so as to constrain the pressure increase. Thus, the relatively large-scale motor of the main refrigerator 212 has to be operated and the energy for the operation is wasted.

Hence, according to the first mode as described above, the auxiliary refrigerator 223 is additionally provided so as to cool the cascade condenser 211 and re-liquefy the $CO_2$ brine gas; in this approach, the operation of the main refrigerator 212 driven by the relatively large scale motor can be dispensed with. Thus, energy saving can be achieved. Further, the pressurized $CO_2$ brine gas can be recovered by the auxiliary refrigerator 223; thus, the temperature of the $CO_2$ brine liquid in the cooling pipes 11 of the ice rink 10 can be reduced. As a result, the increase speed regarding the ice temperature can be constrained, and the operation interval (the stop-to-restart interval) regarding the main refrigerator 212 can be extended. Thus, further energy saving effect can be expected.

In addition, it is preferable that a heat exchanger 224 for recovering sensible heat is provided on the gas discharge line through which the ammonia gas discharged from the auxiliary refrigerator 223 streams; thereby, the sensible heat recovering heat exchanger 224 performs heat exchange between the gas discharged from the auxiliary refrigerator 223 and the warm water that is used for putting the ice surface of the ice rink in good condition. The warm water for putting the ice surface of the ice rink in good condition passes through a circulation loop that includes, but not limited to: a warm water tank 226 in which the warm water is reserved, and a pump 227 that circulates the warm water so that the warm water and the discharge gas discharged from the auxiliary refrigerator 223 perform heat exchange at the heat exchanger 224 where the warm water is heated by use of the waste heat of the discharge gas discharged from the auxiliary refrigerator 223. The operation of the auxiliary refrigerator 223 lasts for a relatively long time span (in comparison to the operation time span of the main refrigerator), the warm water can stably recover the waste heat of the discharge gas even though the amount of the warm water that is heated by recovering the waste heat is small.

Furthermore, the cooling facility 100 according to the first mode may be configured so that the waste heat from an oil-cooler 240 for the main refrigerator 212 is recovered.

The oil cooler 240 cools the refrigerator oil of the refrigerator oil circulation line that passes through the oil cooler 240. In addition, in the present mode, the heat exchange between the high temperature refrigerator oil returned from the main refrigerator 212 and low temperature warm-brine is performed so that the waste heat (from the main refrigerator) is recovered.

To be more specific, a warm-brine feed line 244 and a warm-brine return line 245 are connected to the oil cooler 240, and configure a circulation loop of the warm-brine; through the warm-brine feed line 244, the warm-brine is fed to the oil cooler 240 from the warm brine tank 31. Further, the warm-brine is returned to the warm brine tank 31 from the oil cooler 240. The warm brine fed to the oil cooler 240 from the warm brine tank 31 through the warm-brine feed line 244 is returned to the warm brine tank 31 through the warm-brine return line 245, after the warm brine is heated by the waste heat of the refrigerator oil. In addition, the warm brine reserved in the warm brine tank 31 is fed to the heating pipe 30 via the warm brine circulation line 32, and used for preventing the frost heaving of the ice rink 10.

Further, in addition to the above-described configuration, the warm brine circulating through the condenser 214 can be also used for recovering the waste heat of the main refrigerator 212; thereby, the warm-brine feed line 244 is, via a three-way valve 241, connected to a warm brine return line 217*b* that returns the warm brine to the condenser 214 from the hermetically sealed cooling tower 217; on the other hand, the warm-brine return line 245 is, via a three-way valve 242, connected to a warm brine feed line 217*a* that feeds the warm brine from the condenser 214 to the hermetically sealed cooling tower 217. On a part way (of the passage) between the tree-way valve 242 and the warm brine feed line 217*a*, a check valve 243 that allows the warm brine to stream only along the direction from the three-way valve 242 to the warm brine feed line 217*a*. According to this configuration, by the changeover manipulation regarding the three way valves 241 and 242, the supply source of the warm brine circulating through the oil cooler 240 is switched from the warm brine tank 31 to the hermetically sealed cooling tower 217 or vice versa.

In order to recover the sensible heat of the gas discharged from the main refrigerator 212, it becomes necessary to arrange an additional heat exchanger, in general; in the above-described configuration, the oil cooler 240 of the main refrigerator 212 is used for recovering the warm water. Thus, it becomes unnecessary to provide an additional heat exchanger; and, only by fitting the three way valves, the heat recovery can be performed. Hence, cost reduction can be achieved.

In addition, in the ammonia refrigerating cycle, a heat exchanger that makes use of the sensible heat of the gas discharged from the main refrigerator 212 may be provided instead of the heat recovery contrivance that utilizes the waste heat from the oil cooler 240, in order to heat the warm brine. The configuration from this point of view is described in detail in the following second mode.

(Second Mode of Ice Rink Cooling Facility)

Figure 2:
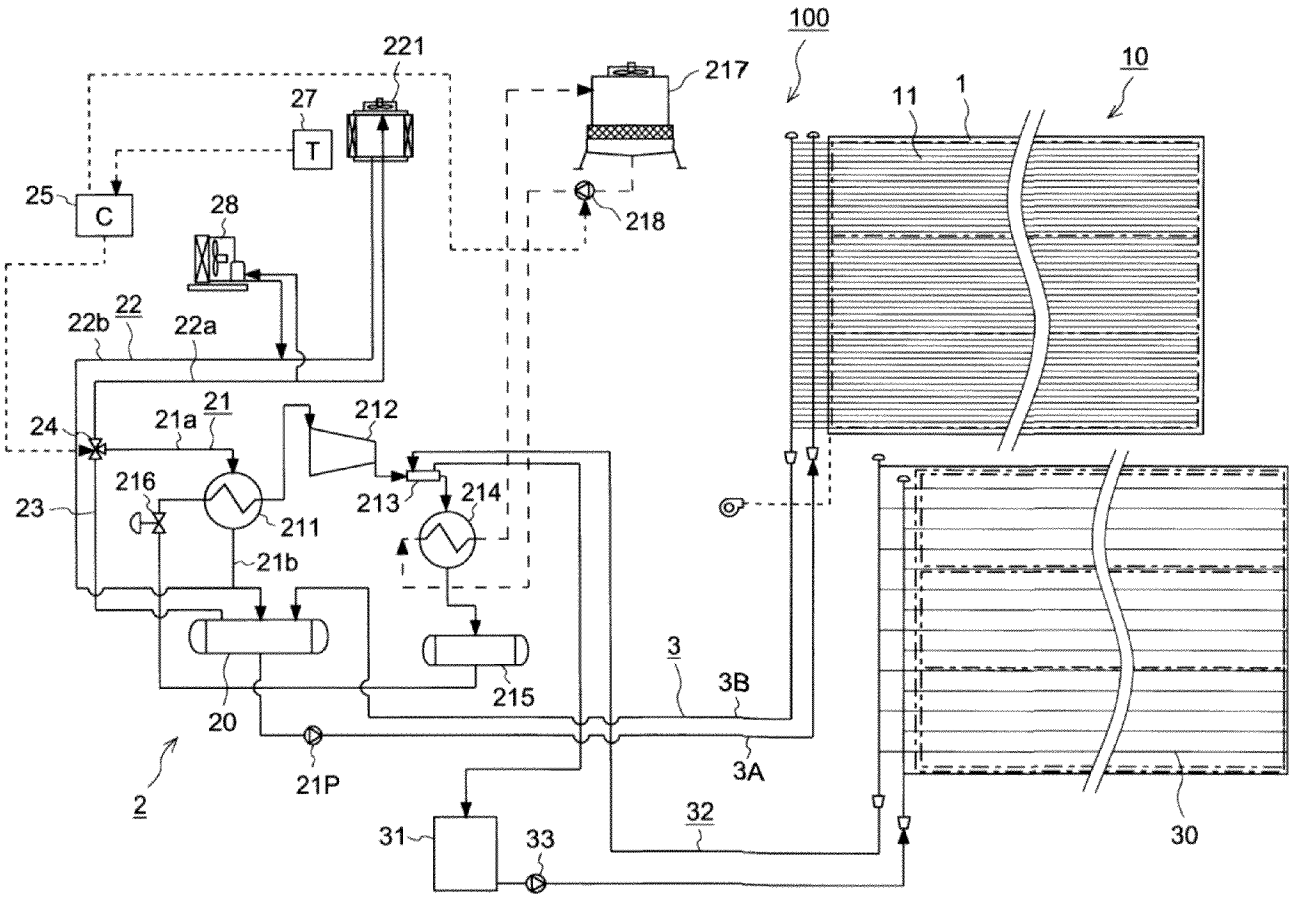
FIG. 2 shows the whole outline of the ice rink cooling facility according to a second mode of the present invention.

FIG. 2 shows the whole outline of the ice rink cooling facility according to the second mode of the present invention; regarding FIG. 2, the explanation that is the same as the explanation regarding FIG. 2 is hereby omitted.

The ice rink cooling facility 100 according the present second mode is mainly provided with the cooling pipe bank 1 including, but not limited to, a plurality of cooling pipes 11, and a refrigerating device 2 including, but not limited to, a $CO_2$ circulation circuit 3 and an ammonia refrigerating cycle 2.

The $CO_2$ circulation circuit 3 is connected to the $CO_2$ receiver 20.

To the lower part of the $CO_2$ receiver 20, the $CO_2$ feed line 3A is connected so that the $CO_2$ liquid brine is supplied to the cooling pipe bank 1; while the $CO_2$ brine passes through the cooling pipe bank 1, a part of $CO_2$ brine changes into the gas-liquid phase $CO_2$ brine; and, the gas-liquid phase $CO_2$ brine returns to the $CO_2$ receiver 20 via the $CO_2$ return line 3B that is connected to an upper part of the $CO_2$ receiver 20.

Further, a first re-liquefaction line 21 as well as a second re-liquefaction line 22 is connected to an upper part of the $CO_2$ receiver 20, both lines being arranged in parallel. The $CO_2$ brine gas is fed through the re-liquefaction line 21 and 22 so as to be re-liquefied into the $CO_2$ brine liquid; and, the $CO_2$ brine liquid returns to the $CO_2$ receiver 20.

On the first re-liquefaction line 21, a cascade condenser 211 in which the $CO_2$ brine is cooled by the ammonia refrigerant that is cooled in the ammonia refrigerating cycle including the main refrigerator 212 is arranged.

Further, the ammonia refrigerating cycle is formed as a closed circuit on which the cascade condenser 211, the main refrigerator 212 that is a compressor, a condenser 214 that is of a water cooling type, a high-pressure ammonia receiver 215 and an expansion valve 216 are arranged in order. The main refrigerator 212 compresses the ammonia refrigerant gas that is evaporated by the heat of the $CO_2$ brine at the cascade condenser 211; and, the pressure and the temperature of the ammonia refrigerant gas are enhanced. Then, the ammonia refrigerant gas of a high temperature and a high pressure is cooled and condensed into a liquefied state at the condenser 214; and, the liquefied ammonia refrigerant is reserved in the high-pressure ammonia receiver 215. The ammonia refrigerant liquid reserved in the high-pressure ammonia receiver 215 is appropriately fed to the expansion valve 216 so as to expand (be depressurized); the depressurized ammonia refrigerant liquid is fed to the cascade condenser 211 so as to cool the $CO_2$ brine gas.

In addition, through the condenser 214 of a water-cooled type, the cooling water that is cooled by passing through the cooling tower 217 is circulated by means of the cooling water pump 218.

Further, it is preferable that the ammonia refrigerating cycle is provided with a heat exchanger 213 in which warm brine is heated by the sensible heat of the discharge gas discharged from the main refrigerator 212. The explanation regarding the heat exchanger 213 is given later.

The second re-liquefaction line 22 is arranged outdoors; and, a $CO_2$ re-liquefaction device 221 of an air-cooling type is provided on the second re-liquefaction line 22, so as to cool the $CO_2$ brine by use of the outdoor air. The air-cooling type $CO_2$ re-liquefaction device 221 is a device that cools and re-liquefies the $CO_2$ brine streaming in the pipes placed in an outdoor-airflow formed by a fan. The air-cooling type $CO_2$ re-liquefaction device 221 is provided in order to re-liquefy the $CO_2$ brine gas; thus, this device 221 is used in a case where the outdoor temperature is not higher than a temperature at which the $CO_2$ brine gas is re-liquefied. The device 221 is preferably used in a case where the outdoor temperature is not higher than −10° C.

The above-described first re-liquefaction line 21 and second re-liquefaction line 22 are connected to the $CO_2$ receiver 20, both lines being arranged in parallel; thereby, it is preferable that both the lines are selectively changed over into each other, by means of a three-way valve 24.

To be more specific, the first re-liquefaction line 21 is connected to an upper part of the $CO_2$ receiver 20; and, the first re-liquefaction line 21 includes, but not limited to, a main re-liquefaction feed line 23 through which the $CO_2$ brine gas is fed, a first re-liquefaction branch line 21*a* that is branched from the main re-liquefaction feed line 23 and is connected to the cascade condenser 211, and a first re-liquefaction return line 21*b* that connects the cascade condenser 211 to the $CO_2$ receiver 20. On the other hand, the second re-liquefaction line 22 includes, but not limited to, the main re-liquefaction feed line 23, a second re-liquefaction branch line 22*a* that is branched from the main re-liquefaction feed line 23 and is connected to the air-cooling type $CO_2$ re-liquefaction device 221, and a second re-liquefaction return line 22*b* that connects the air-cooling type $CO_2$ re-liquefaction device 221 to the $CO_2$ receiver 20.

Further, the three-way valve 24 is set among the main re-liquefaction feed line 23, the first re-liquefaction branch line 21*a* and the second re-liquefaction branch line 22*a*.

A controller 25 controls the changeover from the first re-liquefaction branch line 21*a* to the second re-liquefaction branch line 22*a* or vice versa. Thereby, in a case where the outdoor temperature detected by the measuring means is not higher than a prescribed first temperature threshold, the controller 25 preferably controls the three-way valve 24 so that the $CO_2$ brine circulates through the second re-liquefaction line 22; in a case where the outdoor temperature exceeds a second temperature threshold that is set higher than the first temperature threshold, the controller 25 preferably controls the three-way valve 24 so that the $CO_2$ brine circulates through the first re-liquefaction line 21. In addition, the second temperature threshold may be the same as the first temperature threshold. It is further preferable that the first temperature threshold is set not higher than −10° C.; in this way, the $CO_2$ brine gas can be appropriately re-liquefied.

Further, in addition to the above-described configurations, the changeover between the operation and the shutdown regarding the main refrigerator 212 may be performed based on the ice temperature; thereby, the ice temperature of the ice rink 10 is continuously detected by the temperature detecting means; in a case where the ice temperature of the ice rink 10 is not lower than a changeover temperature threshold that is prescribed in advance, the main refrigerator 212 is operated; and, in a case where the ice temperature is lower than the changeover temperature threshold, the main refrigerator 212 is stopped. Thus, the operating power expenditure can be constrained.

In the next place, the operation regarding the ice rink cooling facility 100 is explained. Incidentally, the temperatures described in the following explanation are mere examples.

The outdoor temperature measured by a temperature measuring means 27 is inputted into the controller 25; in a case where the outdoor temperature is not lower than the second temperature threshold (e.g. −10° C.), the controller 25 controls the three-way valve 24 so that the flow direction through the valve 24 is changed over, and the $CO_2$ brine circulates through the first re-liquefaction line 21.

In the refrigerating device 2 in which the first re-liquefaction line 21 is active (is placed under an operating condition), the $CO_2$ brine liquid of an approximately −8° C. that is delivered by the $CO_2$ liquid pump 21P is fed to the cooling-pipe bank 1 arranged in the ice rink 10, through the $CO_2$ feed line 3A; the $CO_2$ brine liquid fed to the cooling-pipe bank 1 cools the ice; while the $CO_2$ brine passes through the cooling pipe bank 1, a part of $CO_2$ brine changes into the gas-liquid phase $CO_2$ brine; and, the gas-liquid phase $CO_2$ brine at a temperature level of approximately −8° C. returns to the $CO_2$ receiver 20 through the $CO_2$ return line 3B. At the cooling-pipe bank 1, the ice of the rink is cooled by use of the evaporating latent heat of the $CO_2$ brine; thus, there is little difference between the temperature of the $CO_2$ brine liquid fed through the $CO_2$ feed line 3A and the temperature of the $CO_2$ gas-liquid brine fed through the $CO_2$ return line 3B. Hence, the temperature distribution all over the cooling pipe bank 1 can be evenly kept, and stable temperature regulation can be easily performed.

Almost of the $CO_2$ gas component out of the $CO_2$ gas-liquid brine that has returned to the $CO_2$ receiver 20 is fed to the cascade condenser 211 through the main re-liquefaction feed line 23 and the first re-liquefaction branch line 21*a*; at the cascade condenser 211, the $CO_2$ brine gas is cooled by the ammonia refrigerant that is cooled in the ammonia refrigerating cycle, and the $CO_2$ brine gas is re-liquefied. The re-liquefied $CO_2$ brine returns to the $CO_2$ receiver 20 through the first re-liquefaction return line 21*b*. In this way, the $CO_2$ brine circulates in the first re-liquefaction line 21 and is re-liquefied.

When the detected outdoor temperature that is inputted into the controller 25 becomes not higher than the first temperature threshold (e.g. −10° C.), the controller 25 controls the three-way valve 24 so that the flow direction through the valve 24 is changed over and the $CO_2$ brine circulates through the second re-liquefaction line 22.

In the refrigerating device 2 in which the second re-liquefaction line 22 is active (i.e. being under an operating condition), the main refrigerator 212 of the ammonia refrigerating cycle is stopped; the $CO_2$ brine from the $CO_2$ receiver 20 is fed to the air-cooling type $CO_2$ re-liquefaction device 221 via the main re-liquefaction feed line 23 and the second re-liquefaction branch line 22*a*. The $CO_2$ brine is cooled by the outdoor air at the air-cooling type $CO_2$ re-liquefaction device 221, and re-liquefied; the re-liquefied $CO_2$ brine liquid returns to the $CO_2$ receiver 20 through the second re-liquefaction return line 22*b*, by use of natural circulation (gravity circulation). In this way, in the second re-liquefaction line 22, the $CO_2$ brine is cooled by the outdoor air is circulated by natural circulation; thus, the drive power for driving a refrigerator or a pump can be dispensed with; and, the running cost for manufacturing the ice of the ice rink 10 or maintaining the ice temperature can be reduced.

Further, in the present second mode, the $CO_2$ brine liquid that is re-liquefied through the first re-liquefaction line 21 and the second re-liquefaction line 22 is fed to the cooling-pipe bank 1 so as to cool the ice rink; the cold heat is generated mainly by the evaporating latent heat of the $CO_2$ brine; thus, there is little difference between the temperature of the $CO_2$ brine liquid fed through the $CO_2$ feed line 3A and the temperature of the $CO_2$ gas-liquid brine fed through the $CO_2$ return line 3B. Hence, the temperature distribution all over the cooling pipe bank 1 can be evenly kept, and stable temperature regulation can be easily performed.

Moreover, in the ammonia refrigerating cycle used for the first re-liquefaction line 21, the evaporation temperature can be set high; thus, the high efficiency operation can be performed.

Furthermore, by use of the air-cooling type $CO_2$ re-liquefaction device 221 provided on the second re-liquefaction line 22, the $CO_2$ brine is cooled by the outdoor air, and circulated by natural circulation so as to be re-liquefied; thus, the running cost can be reduced.

Further, the three-way valve 24 is provided so that one of the first re-liquefaction line 21 and the second re-liquefaction line 22 is selectively adopted; thus, the most efficient re-liquefaction means can be selected in response to the operation condition.

In addition, in response to the outdoor temperature, when the air-cooling type $CO_2$ re-liquefaction device 221 is applicable, the second re-liquefaction line 22 is made use of; when the air-cooling type $CO_2$ re-liquefaction device 221 is not applicable, the first re-liquefaction line 21 is made use of. In this way, it is realized that the outdoor temperature is made the best possible use of, and the driving power expenditure is constrained to a minimal level.

Further, it is preferable that the heating pipes 30 are constructed on the under-floor ground under the ice rink 10; the heating pipes 30 are arranged so that the cold heat toward the under-floor ground from the cooling-pipe bank 1 does not freeze the under-floor ground and the under-floor ground is prevented from rising-up (frost heaving prevention). Thereby, the warm brine is heated by the waste heat of the main refrigerator 212 at the heat exchanger 213; the heated warm brine streams through the heating pipes 30. To be more specific, the warm brine is reserved in the warm brine tank 31, and fed to the heating pipes 30 via the warm brine circulation line 32 by means of a warm brine circulation pump 33; the warm brine returns to the heat exchanger 213, where the warm brine is again heated; and, the warm brine is reserved in the warm brine tank 31. In this way, in order to heat the warm brine that streams through the heating pipes 30, the sensible heat of the discharge gas discharged from the main refrigerator 212 is made use of; thus, the energy efficiency of the facility can be enhanced and the running cost can be reduced.

Further, a $CO_2$ re-liquefaction refrigerator 28 of a small scale may be connected to the second re-liquefaction line 22. The $CO_2$ re-liquefaction refrigerator 28 is a refrigerator that functions in an auxiliary manner; the $CO_2$ re-liquefaction refrigerator 28 re-liquefies the $CO_2$ brine when the ice rink is closed or in an off-season. On a day when the ice rink 10 is closed, there is no cooling load associated with skaters, athletes and lighting equipment; thus, the cooling load for maintaining the ice temperature is also low. Hence, the refrigerating device 2 including the ammonia refrigerating cycle or the air-cooling type $CO_2$ re-liquefaction device 221 may be stopped; and, the condition of the ice board can be maintained only by operating the $CO_2$ re-liquefaction refrigerator 28 and the $CO_2$ liquid pump 21P.

In an off-season, most of the $CO_2$ brine that remains in the cooling-pipe bank 1 is recovered in the $CO_2$ receiver 20 by the manner that the refrigerating device 2 is operated, and the $CO_2$ brine is liquefied by the cascade condenser 211; then, during the off-season, the $CO_2$ re-liquefaction refrigerator 28 is operated so that the pressure in the $CO_2$ receiver 20 is maintained not higher than a prescribed pressure level.

Figure 3:
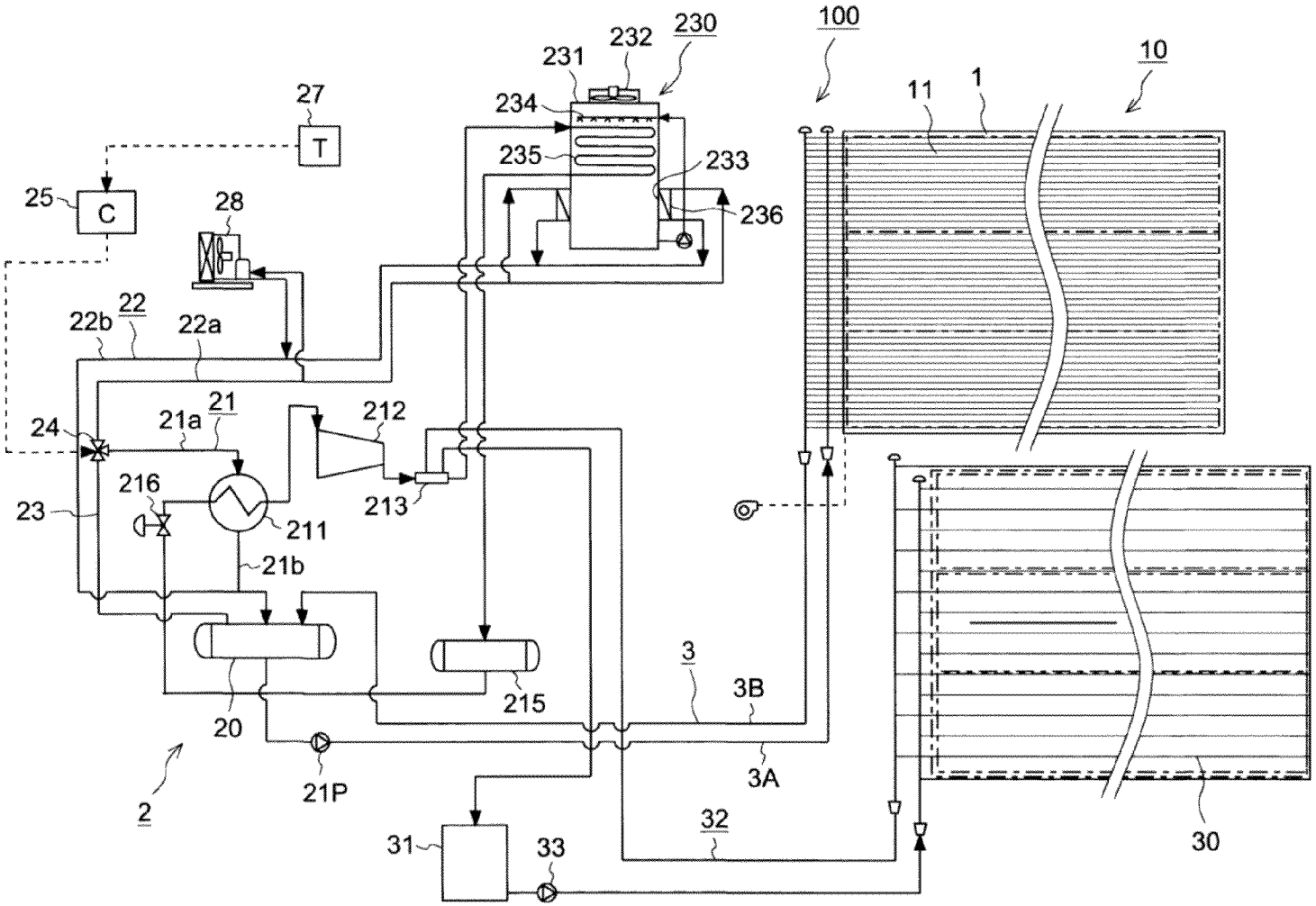
FIG. 3 shows the whole outline of the ice rink cooling facility according to a variation of the second mode of the present invention.

FIG. 3 shows the whole outline of the ice rink cooling facility according to a variation of the second mode of the present invention; in the variation, a evaporating type condenser 230 is provided as an alternative to the condenser 214 of a water-cooling type.

The evaporating type condenser 230 is arranged between the main refrigerator 212 and the high-pressure ammonia liquid receiver 215, and preferably outdoors at the same time.

The evaporating type condenser 230 is provided with a vertically arranged duct 231, and a fan 232 that is placed at the upper part of the vertically arranged duct 231; thereby, the outdoor air is sucked into the duct 231 through at least one air suction opening 233 arranged at a lower part of the duct 231; the sucked outdoor air is discharged outside from the upper part of the duct. Inside of the duct 231, a refrigerant pipe coil 235 through which the ammonia refrigerant streams is placed, and water spray nozzles 234 are arranged above the refrigerant pipe coil 235. The ammonia refrigerant streaming in the refrigerant pipe coil 235 and the outdoor air as a cooling medium perform heat exchange so that the refrigerant is condensed; in addition, the cooling of the refrigerant is promoted by the manner that the outer surface of the refrigerant pipe coil 235 is wetted by the water sprayed from the water spray nozzles, as well as the manner that the wetted surface is exposed in the outdoor air flow so that the evaporating latent heat boosts the cooling of the refrigerant.

It is further preferable that the air-cooling type $CO_2$ re-liquefaction device is integrated with the evaporating type condenser 230. To be more specific, a circuit line of the pipe 236 in which $CO_2$ brine streams is arranged so that the circuit line of the pipe 236 passes by the air suction opening 233; and, the pipe 236 is connected to the second re-liquefaction line 22. In this way, the device installation area can be reduced; further, in a case where the first re-liquefaction line 21 and the second re-liquefaction line are active at the same time, both the lines make use of the fan 232. Thus, the driving power expenditure can be reduced.

EXAMPLES AS TO COOLING PIPE STRUCTURE

FIGS. 4(A), 4(B-1) and 4(B-2) show a first configuration example regarding the cooling pipes for cooling the ice rink; FIG. 4(A) shows a perspective view; FIG. 4(B-1) shows a cross-section view; and, FIG. 4(B-2) shows a cross section view regarding another configuration example (a variation of the first configuration example). It is hereby noted that, in FIG. 4(A), a part of a planar heat conduction member 16 arranged on and over a plurality of cooling pipes 11 is omitted so that the shape and the arrangement regarding the cooling pipes 11 are easily understood.

As shown in FIG. 4(A), a cooling-pipe bank 1A is constructed in the floor region of the ice rink 10. The cooling-pipe bank 1A is provided with a plurality of linear cooling pipes 11A (hereafter abbreviated to straight pipes) that are arranged along the long side direction regarding the ice rink 10, and a plurality of bent pipes 12, each bent pipe 12 connecting an end of a strait pipe 11A to the same side end of an adjacent straight pipe 11A.

Further, at another end side of the straight pipes (namely, the end side is the counter end side where bent pipes are arranged), a $CO_2$ feed pipe (header) 13 and a $CO_2$ return pipe (header) 14 are arranged so that both pipes (headers) 13 and 14 are connected to the multiple straight pipes; the $CO_2$ feed pipe (header) 13 is connected to the $CO_2$ feed line 3A, and the $CO_2$ return pipe (header) 14 is connected to the $CO_2$ return line 3B Further, the multiple straight pipes 11A configuring the cooling-pipe bank 1A are arranged so that each ridgeline of each straight pipe 11A is included approximately in a common plane, the common plane forming the upper surface of the cooling-pipe bank 1A; and, on the upper surface of the bank 11A, the planar heat conduction member 16 is arranged.

As shown in FIG. 4(B-1), on and over the upper surface of the cooling-pipe bank 1A, the planar heat conduction member 16 is arranged so as to come in contact with the upper surface of the cooling-pipe bank 1A. The planar heat conduction member 16 is formed with a material of a high heat-conductivity and a high strength; for instance, a metal material such as copper, aluminum and so on are used for the member 16.

Further, it is preferable that the planar heat conduction member 16 is provided with a plurality of holes 16*a*; for instance, a punching metal plate or a mesh type metal plate is used as the member 16. The reason why such metal plates are used is as follows. In installing concrete after the cooling-pipe bank 1A and the planar heat conduction member 16 are arranged, the concrete can be poured through the holes 16*a*, even into every corner of the space between the adjacent cooling pipes by the manner that the concrete is poured from the upper side of the planar heat conduction member 16; thus, the construction work regarding the cooling pipe structure can be easy. Further, in laying concrete, the holes 16*a* take a role in letting the trapped air escape.

In addition, the planar heat conduction member 16 may be only arranged on the upper surface (the plane which the mountain ridgelines of the straight pipes form) of the cooling-pipe bank 1A so as to keep contact therewith. It is not always necessary to fix the planar heat conduction member 16 to the cooling-pipe bank 1A; however, in order to prevent the planar heat conduction member 16 from getting free from the cooling-pipe bank 1A, the heat conduction body 16 may be formed so as to be integrated with the cooling-pipe bank 1A, in advance; or, the heat conduction body 16 and the cooling-pipe bank 1A may be tied and fixed to each other, by means of at least one tying member (not shown).

As described above, the cold heat of the $CO_2$ brine is transferred from the cooling pipe bank 1A to the planar heat conduction member 16 so that the ice rink 10 is cooled via the heat conduction member; thus, the cold heat can be evenly transferred to a space between a cooling pipe 11A and the adjacent cooling pipe 11A thereof; in other words, the distance between the adjacent cooling pipes can be increased in comparison to the conventional distance. For instance, when the above-described invention is applied to the conventional ice rink where the pipe-to-pipe distance is 100 mm, the distance can be approximately doubled (i.e. to a level of 200 mm).

Further, by use of the planar heat conduction member 16, the temperature distribution regarding the to-be-cooled region can be almost even and smooth; thus, the ice layer thickness regarding the ice rink 10 can be evenly distributed. In addition, since the planar heat conduction member 16 is arranged on the upper surface of the cooling pipe bank 1A, the floor part of the ice rink 10 can be reinforced. It can be particularly mentioned that the reinforcing rods (or the similar structure members) that are often constructed in the conventional ice rinks for the purpose of the floor part reinforcement can be dispensed with, by arranging the planar heat conduction member 16 according to the present mode.

FIG. 4(B-2) shows a cross section view regarding another configuration example (a variation of the first configuration example) different from the above-described example (i.e. FIG. 4(B-1)). As shown in FIG. 4(B-2), a pressing plate 17 is installed on the upper surface of the planar heat conduction member 16; the pressing plate 17 is provided with a plurality of opening holes 17*a*, and the area of the hole 17*a* is larger than the area of the hole 16*a*. Further, a plurality of tying members 18 is provided so that the planar heat conduction member 16 is held between the pressing plate 17 and the cooling pipe 11A, by use of the tying member 18.

In this way, based on the installation of the pressing plate 17, the fitness (adhesion) between the planar heat conduction member 16 and the cooling pipe 11A is enhanced so that the heat conductivity efficiency can be maintained at a high level; in addition, the planar heat conduction member 16 and the cooling pipe 11A are bound with each other so that both members 16 and 11A can be surely fixed to each other. Particularly in a case of constructing the concrete structure, the cooling pipe 11A can be prevented from rising from the planar heat conduction member 16; and, the heat conductivity can be prevented from being spoiled. Incidentally, the opening holes 17*a* whose area is larger than the area of the hole 16*a* are provided so that the concrete can pour into every corner of the bottom part in constructing the concrete structure, and the trapped air can escape after the concrete is constructed.

Figure 5:
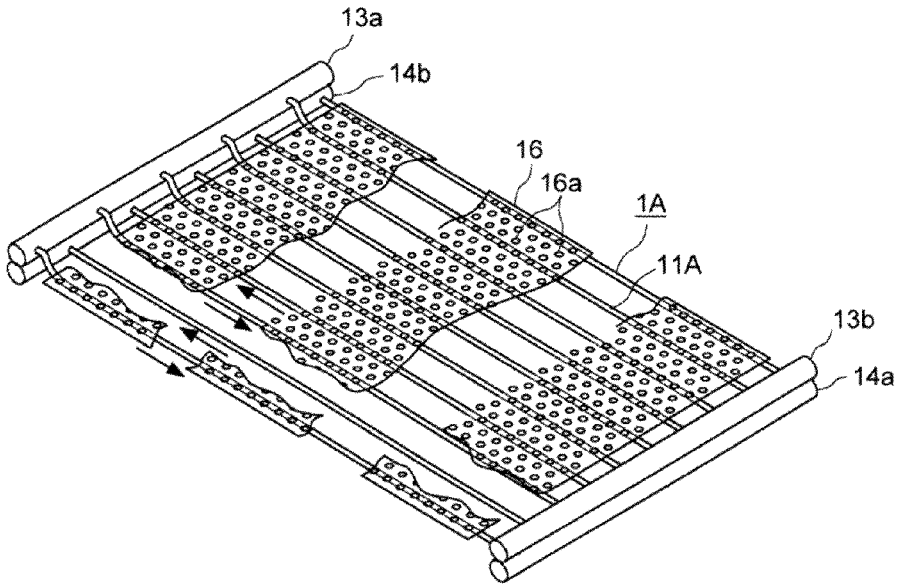
FIG. 5 shows a perspective view regarding a variation of the ice rink cooling pipe structure shown in FIGS. 4(A), 4(B-1) and 4(B-2)

FIG. 5 shows a perspective view regarding a variation for the configuration example of FIGS. 4(A), 4(B-1) and 4(B-2).

In this cooling pipe structure, a plurality of straight pipes 11A is connected to a $CO_2$ feed pipe (header) 13*a* on an end side (a first end side) of the straight pipes 11A; and, the straight pipes 11A are connected to a $CO_2$ return pipe (header) 14*a* on another side (a second end side) of the straight pipes 11A. Further, a plurality of straight pipes 11A is connected to a $CO_2$ feed pipe (header) 13*b* on an end side (the same as the second end side) of the straight pipes 11A; and, the straight pipes 11A are connected to a $CO_2$ return pipe (header) 14*b* on another side (the same as the first end side) of the straight pipes 11A. As described, the $CO_2$ feed pipe (header) 13*a* and the $CO_2$ return pipe (header) 14*b* are placed on the same side (the first end side); and, the $CO_2$ feed pipe (header) 13*b* and the $CO_2$ return pipe (header) 14*a* are placed on the same side (the second end side).

Further, the $CO_2$ brine fed from the $CO_2$ circulation circuit 3 is supplied to the straight pipes 11A via the $CO_2$ feed pipes (headers) 13*a* and 13*b*; and, the $CO_2$ brine returns to $CO_2$ circulation circuit 3 via the $CO_2$ return pipes (headers) 14*a* and 14*b* after passing through the straight pipes 11A.

FIG. 6 shows a perspective view of a second configuration example regarding the cooling pipe structure for cooling the ice rink.

As shown in FIG. 6, a cooling-pipe bank 1B is constructed in the floor region of the ice rink 10. The cooling-pipe bank 1B is arranged along the long side direction regarding the ice rink 10; a the straight pipes 11B are arranged in parallel along the direction, the distance of each pair of adjacent straight pipes 11B being prescribed.

Further, in this second configuration example, a plurality of straight pipes 11B is connected to a $CO_2$ feed pipe (header) 51*a* on an end side (a first end side) of the straight pipes 11B; and, the straight pipes 11B are connected to a $CO_2$ return pipe (header) 52*a* on another side (a second end side) of the straight pipes 11B. Further, a plurality of straight pipes 11B is connected to a $CO_2$ feed pipe (header) 51*b* on an end side (the same as the second end side) of the straight pipes 11B; and, the straight pipes 11B are connected to a $CO_2$ return pipe (header) 52*b* on another side (the same as the first end side) of the straight pipes 11B. As described, the $CO_2$ feed pipe (header) 51*a* and the $CO_2$ return pipe (header) 52*b* are placed on the same side (the first end side); and, the $CO_2$ feed pipe (header) 51*b* and the $CO_2$ return pipe (header) 52*a* are placed on the same side (the second end side).

Further, the $CO_2$ brine fed from the $CO_2$ circulation circuit 3 is supplied to the straight pipes 11B via the $CO_2$ feed pipes (headers) 51*a* and 51*b*; and, the $CO_2$ brine returns to $CO_2$ circulation circuit 3 via the $CO_2$ return pipes (headers) 52*a* and 52*b* after passing through the straight pipes 11B.

Based on FIGS. 7(A), 7(B) and 7(C), the configuration of the cooling pipes 11B is now explained in detail. Each of FIGS. 7(A), 7(B) and 7(C) shows a cross-section of a cooling pipe provided with a micro-channels structure.

The cooling pipe 11B has a cross-section of a flat shape, and the outer surface of the upper sidewall of the pipe is flat. The cooling pipe 11B forms a micro-channel structure; namely, the pipe 11B is provided with a plurality of microscopic passages through which the $CO_2$ brine streams. The upper sidewall of the pipe 11B acts as a planar heat conduction body. The material of a high heat-conductivity is used for the pipe 11B; the cooling pipe made from aluminum is preferably used. In addition, the cooling pipe 11B is manufactured, for instance, by extrusion molding; and, a corrosion prevention surface-treatment is preferably applied to the surface of the cooling pipe 11B.

The cooling pipe 11B-1 as shown in FIG. 7(A) has a cross-section of a flat shape, and is provided with a plurality of microscopic passages 111, inside of the cooling pipe 11B-1. The cross-section of the microscopic passage 111 forms a circular shape. The multiple microscopic passages 111 are arranged in parallel inside of the cooling pipe 11B-1, the distance of each pair of adjacent microscopic passages 111 being prescribed.

The cooling pipe 11B-2 as shown in FIG. 7(B) has a cross-section of a flat shape, and is provided with a plurality of microscopic passages 112, inside of the cooling pipe 11B-2. The cross-section of the microscopic passage 111 forms a circular shape. The diameter of the microscopic passages 112 is smaller than the diameter of the microscopic passages 111 of the cooling pipe 11B-1 shown in FIG. 7(A); and, the number of the microscopic passages 112 in the cooling pipe 11B-2 is greater than the number of the microscopic passages 111 in the cooling pipe 11B-1.

Regarding the cooling pipe 11B-1 in FIG. 7(A) and the cooling pipe 11B-2 in FIG. 7(B), the cross-sections of the passages 111 and 112 are circular; thus, the pressure resistance can be enhanced.

The cooling pipe 11B-3 as shown in FIG. 7(A) has a cross-section of a flat shape, and is provided with a plurality of microscopic passages 113 inside of the cooling pipe 11B-3. The cross-section of the microscopic passage 113 forms an approximately square shape. Regarding the cooling pipe 11B-3, since the cross-section of the microscopic passage 113 is approximately square, a larger heat conduction area a can be obtained. Thus, the cooling efficiency can be enhanced.

According to the second configuration example (regarding the cooling pipes for the ice rink), the upper sidewall of each of the cooling pipes 11B-1, 11B-2 and 11B-3 forms the planar heat conduction body; each of the cooling pipes 11B-1, 11B-2 and 11B-3 has a cross-section of a flat shape, and is provided with a plurality of microscopic passages. Hence, the heat conductivity area between each cooling pipe and the $CO_2$ brine can be increased, and the cooling efficiency can be enhanced.

Based on FIGS. 8 and 9, the variations of the above-described second configuration example are explained as follows.

FIG. 8 shows a perspective view regarding a variation of the second configuration example in relation to the ice rink cooling pipe structure depicted in FIG. 6.

In this cooling pipe structure, a $CO_2$ feed pipe (header) 53 and a $CO_2$ return pipe (header) 54 are provided on an end side (a first end side) of the cooling pipe structure; a plurality of intermediate headers 55 are provided on another side (a second end side) of the cooling pipe structure. A cooling pipe 11B connects the $CO_2$ feed pipe (header) 53 with an intermediate header 55, while another cooling pipe 11B connects the intermediate header 55 to the $CO_2$ return pipe (header) 54.

The $CO_2$ brine is fed from the $CO_2$ feed pipe (header) 53 to the intermediate header 55 through a cooling pipe 11B; and, the $CO_2$ brine is returned to the $CO_2$ return pipe (header) 54 from the intermediate header 55 through another cooling pipe 11B.

FIG. 9 shows a perspective view regarding another variation of the second configuration example in relation to the ice rink cooling pipe structure depicted in FIG. 6. It is hereby noted that, in FIG. 9, a part of a planar heat conduction member 16 arranged on the cooling pipe bank 1B is omitted so that the shape and the arrangement regarding the cooling pipes 11B are easily understood.

The present cooling pipe structure is provided with a planar heat conduction member 16 besides the upper sidewalls of the cooling pipes, the sidewalls acting as the planar heat conduction body. The heat conduction member 16 is configured as a member separated from the cooling pipe 11B. The specific configurations of the planar heat conduction member 16 are the same as the configurations shown in FIGS. 4(A), 4(B-1), 4(B-2) and 5. Thus, the cooling pipe structure is provided with the upper sidewalls as the planar heat conduction body of the cooling pipes 11B and the planar heat conduction member 16; in this way, the cooling efficiency can be further enhanced.

In the next place, based on FIGS. 10(A), 10(B), 11 and 12, the header structure regarding the cooling pipes is explained.

The header structure can be applicable to: the $CO_2$ feed pipe 13 and the $CO_2$ return pipe 14 that are depicted in FIG. 4; the $CO_2$ feed pipes 13*a* and 13*b* and the $CO_2$ return pipes 14*a* and 14*b* that are depicted in FIG. 5; the $CO_2$ feed pipes 51*a* and 51*b* and the $CO_2$ return pipes 52*a* and 52*b* that are depicted in FIG. 6; and, the $CO_2$ feed pipe 53 and the $CO_2$ return pipe 54 that are depicted in FIG. 8.

FIGS. 10(A) and 10(B) show a first configuration example of a header structure regarding the ice rink cooling pipes; FIGS. 10(A) and 10(B) show the plan view and a side view respectively.

The header structure 60 in the first configuration example is provided with:

more than two sub-headers 61, a group of cooling pipes 11B being connected to one of the sub-headers 61;

more than two sub-headers 65, a group of cooling pipes 11B being connected to one of the sub-headers 65;

a main header 81 to which the multiple sub-headers 61 as well as the multiple sub-headers 65 are connected;

a main header 82 to which the multiple sub-headers 61 as well as the multiple sub-headers 65 are connected.

The cooling pipes 11B are connected to the $CO_2$ circulation circuit via the sub-headers 61, the sub-headers 65, the main header 81 and the main header 82.

To be more specific, the header structure 60 is provided with:

the feed-side main header 81 that feeds the $CO_2$ brine to the cooling pipes 11B from the $CO_2$ circulation circuit;

the return-side main header 82 that returns the $CO_2$ brine from the cooling pipes 11B to the $CO_2$ circulation circuit;

the feed-side sub-headers 61 that communicate the feed-side main header 81 with the cooling pipes 11B; and, the return-side sub-headers 65 that communicate the cooling pipes 11B with the return-side main header 82.

The feed-side main header 81 and the return-side main header 82 are arranged, next to each other, as well as, in parallel to each other.

A flexible pipe 63 is connected to the feed-side main header 81 via a standpipe 64; and, the feed-side sub-header 61 is connected to the flexible pipe 63. The feed-side sub-header 61 is provided with a plurality of sockets 62 that are spaced at predetermined intervals; the upstream side end of the cooling pipe 11B is attached to the socket 62, and fixed to the socket 62 by welding.

Similarly, a flexible pipe 67 is connected to the return-side main header 82 via a standpipe 68; and, the flexible pipe 67 is connected to the return-side sub-header 65. The return-side sub-header 65 is provided with a plurality of sockets 66 that are spaced at predetermined intervals; the upstream side end of the cooling pipe 11B is attached to the socket 66, and fixed to the socket 66 by welding.

Further, FIG. 10(B) also shows an example of the configuration of the ice rink; a waterproof layer 94, a heat insulation layer 93 and a concrete layer 92 are provided over a groundwork concrete layer 95, in order, from below upward; the cooling pipes 11B are arranged on the upper side of the concrete layer 92. In addition, an ice board 91 is formed above the cooling pipes 11B.

FIGS. 11(A) and 11(B) show a second configuration example of a header structure regarding the ice rink cooling pipes; FIGS. 11(A) and 11(B) show a plan view and a side view respectively; FIG. 12 shows the whole outline of the second configuration example of the header structure regarding the ice rink cooling pipes.

The header structure 70 in the second configuration example is provided with:

more than two sub-headers 71, a group of cooling pipes 11B being connected to one of the sub-headers 71;

more than two sub-headers 75, a group of cooling pipes 11B being connected to one of the sub-headers 75;

a main header 81 to which the multiple sub-headers 71 as well as the multiple sub-headers 75 are connected;

a main header 82 to which the multiple sub-headers 71 as well as the multiple sub-headers 75 are connected.

The cooling pipes 11B are connected to the $CO_2$ circulation circuit via the sub-headers 71, the sub-headers 75, the main header 81 and the main header 82.

To be more specific, the header structure 70 is provided with:

the feed-side main header 81 that feeds the $CO_2$ brine to the cooling pipes 11B from the $CO_2$ circulation circuit;

the return-side main header 82 that returns the $CO_2$ brine from the cooling pipes 11B to the $CO_2$ circulation circuit;

the feed-side sub-headers 71 that communicate the feed-side main header 81 with the cooling pipes 11B; and, the return-side sub-headers 75 that communicate the cooling pipes 11B with the return-side main header 82.

The feed-side main header 81 and the return-side main header 82 are arranged, next to each other, as well as, in parallel to each other.

The feed-side sub-header 71 is provided with a plurality of sockets 72 that are spaced at predetermined intervals; the cooling pipe 11B is attached to the socket 72, and fixed to the socket 72 by welding. In addition, the sub-header 71 is provided with a connection pipe 73 so that the sub-header 71 is connected to the main header 81 via the connection pipe 73. The connection pipe 73 is configured, for instance, with a standpipe, a flexible pipe and so on. Similarly, the return-side sub-header 75 is provided with a plurality of sockets 76 and a connection pipe 77.

Each of the feed-side sub-headers 71 is connected to the feed-side main header 81 via the connection pipe 73. Similarly, Each of the return-side sub-headers 75 is connected to the return-side main header 82 via the connection pipe 77.

In the above-described header structure, each of the multiple cooling pipes 11B is not directly connected to the main header 81 or 82; each of the multiple cooling pipes 11B is connected the main header 81 or 82, via the sub-header 61 or 65, or the sub-header 71 or 75. In other words, the multiple cooling pipes 11B are classified into a plurality of groups; each group of cooling pipes 11B is connected to the sub-header 61 or 65, or the sub-header 71 or 75, each group of the cooling pipes 11B being unitized into one component. Thus, in a case where defective conditions are encountered in some of the cooling pipes 11B, it is not necessary to stop the brine flow in all the cooling pipes; and, the brine flow of only the cooling pipe unit in defective condition may be stopped. In this way, the operation of the refrigerating facility can be continued. In addition, only the cooling pipe unit in defective condition may be replaced with new one. Accordingly, the maintenance or repair work can be easily performed.

Further, the cooling pipes 11B are generally jointed to the headers by welding; when a lot of cooling pipes 11B is welded to the main header 81 or 82, the main header 81 or 82 may be often bent due to the superposing of welding deformation. According to the above-described structure, the cooling pipes 11B are welded to the sub-header 61 or 65, or the sub-header 71 or 75, the length of each sub-header 61, 65, 71 or 75 being shorter than the length of the main header 81 or 82. Thus, the welding deformation can be constrained to a small level. Further, since the cooling pipes 11B are connected to the sub-header 61 or 65, or the sub-header 71 or 75, the cooling pipes are easily constructed.

FIGS. 13(A) and 13(B) show a bobbin for the cooling pipe; FIGS. 13(A) and 13(B) show a plan view and a side view respectively. The bobbin 85 is used in transporting the cooling pipes 11B of the micro-channel structure shown in FIGS. 6, 7(A), 7(B), 7(C), 8 and 9. The cooling pipe bobbin 85 is provided with a winding drum 86 of a cylindrical shape and a pair of sword guards 87 that is placed on both the end sides of the winding drum 86. The width of the winding drum is set in response to the major axis length of the unit regarding the cooling pipe 11B.

By use of the above-described cooling pipe bobbin 85, the cooling pipe 11B of a predetermined length is wound around the winding drum 86, and transported.

Further, the width of the winding drum 86 may be set so as to correspond to the length of the sub-header 61 or 65; and, the cooling pipes 11B that are connected to the sub-header 61 or 65 may be wound around the winding drum 86 so as to be transported together with the sub-header.

FIGS. 14(A) and 14(B) show an ice rink for curling to which this mode of the present invention is applicable; FIGS. 14(A) and 14(B) show a plan view and a side view respectively.

As shown in FIGS. 14(A) and 14(B), the curling use ice rink 10A is not provided with a rink fence around the sheets 41 that are the athletic fields of curling, different from an ice rink for speed skating, figure skating, or ice hockey. A divider 42 is provided between a sheet 41 and the adjacent sheet 41 so that the stone is prevented from entering the adjacent sheet.

In the present mode, in order that the temperature of the ice board 40 regarding the sheet 41 is prevented from being influenced by the audience in the spectator stand, an airflow wall (an air curtain) 48 is formed along the circumference of the ice rink 10A; thereby, the airflow is spouting from below upward.

To be more specific, an air duct 47 is arranged along the circumference of the ice rink 10A; a blower 45 is provided so as to feed air to the air duct 47; and, a heat exchanger 46 is provided so as cool the air fed from the blower 45. At the apex part of the air duct 47, a slit 47*a* is provided so as to spout the airflow; thus, the air curtain 48 is formed along the circumference of the ice rink 30. The height of the air curtain formed along the circumference of the ice rink 10A is limited to a certain level from the floor part of the ice rink 10A; and, the air curtain does not affect the audience vision. In this way, the temperature of the curling use ice board 40 can be evenly maintained without drawing any trouble on the audience and the athletes First Application Example In a first application example, a thermal analysis for a skating-use ice rink provided with the cooling facility according to the present mode is performed, so that the influence of the cooling pipe structure under the conditions regarding the ice board is verified. Incidentally, in performing the thermal analysis, a fluid-flow and heat-transfer analysis software application SCRYU/Tetra for Windows Version8 (developed by Software Cradle Co., Ltd.) is made use of.

Further, in the thermal analysis, the cooling pipe structure of the first configuration example shown in FIGS. 4(A), 4(B-1) and 4(B-2) is used (as an analysis model); thereby, the cooling pipes are copper pipes, and the planar heat conduction member is the punching metal plate made from aluminum.

FIG. 15 shows the outline of the analysis model. On the left side of the drawing (FIG. 15), the analysis model for a first condition is shown; on the right side of the drawing (FIG. 15), the analysis model for a third condition is shown. This analysis object is modeled as a substantially 2-dimensional model (an artificially 2-dimensional model); the width is mainly supposed to be 100 mm (a typical distance between the adjacent cooling pipes); and, the shape and the aspect regarding any cross-section in the depth direction is supposed to be unchanged. In other words, the performed analysis is a computer analysis in which the thickness in the depth direction is disregarded. The analysis results will be depicted by use of the cross-sections in FIG. 15.

FIG. 16 shows a table of the analysis conditions. As shown in FIG. 16, as the parameters of the analysis conditions, the room temperature, the underground temperature and the cooling pipe temperature are set at 15° C., 10° C. and −12° C., respectively.

FIG. 17 shows a table that describes the heat conductivity of each layer. In relation to the treatment of the punching metal plate, it is hypothesized that the holes of the punching metal plate are placed at the left and right sides of the cooling pipe, the punching metal plate being on the cooling pipe; the pattern of the punching metal plate is repeated every 100 mm interval (similar to the typical pipe-to-pipe distance) in the width direction in the substantially 2-dimensional model. Thus, it is hypothesized that there is no hole above the cooling pipe in the 50 mm width range (from the −25 mm left side point to the 25 mm right side point); and, the holes are placed in both the end side 25 mm width ranges (from the −50 mm left side point to the −25 mm left side point, as well as, from the 25 mm right side point to the 50 mm right side point). It is further hypothesized that the heat conductivity regarding the punching metal plate-part where there is no hole is to be the same as the heat conductivity of aluminum; and, the heat conductivity regarding the punching metal plate-part where there is the hole is to be the same as the heat conductivity of concrete, as the hole is fulfilled with concrete. Further, in a case where the open area ratio is different from the above-described 50%, the heat conductivity of the punching metal plate is determined in response to the open area ratio in addition to the aluminum heat conductivity and the concrete heat conductivity.

In the analysis model, the most upper layer is to be a water layer (or an ice layer); however, different from ice, the upper surface of water cannot rise up. Accordingly, it is hypothesized, also due to the limitations from the used software, that the level of the water surface is always constant. As a result, the 0° C. contour line, which is the boundary where ice begins being formed, distributes flat as time passes. Hence, in performing the analysis, in addition to the steady state analysis, the transient change regarding the temperature distribution (2-dimensional distribution over the modeled area) is followed up (i.e. non-steady state analysis is performed) in order to evaluate the unevenness regarding the surface of the ice to be formed. To be more specific, a study is executed on the analyzed temperature distribution at a time point when the water temperature at the level whose height is 30 mm below the water surface becomes approximately −2° C.; and, it is hypothesized that the unevenness of the actually formed ice surface corresponds to the height difference between the highest location point on the 0° C. contour line and the lowest location point on the 0° C. contour line. Thereby, the highest location point is on the middle centerline (along the height direction in the analysis 2-dimensional region), and the lowest point is on the left or the right edge line (along the height direction in the analysis 2-dimensional region). The height difference can be considered as a parameter for evaluating the unevenness of the ice surface to be formed. In this way, the height difference between the location point of 0° C. on the middle center line of the analysis region and the location point of 0° C. on the rightmost or leftmost side of the analysis region is evaluated for comparison.

The analysis results are shown as follows.

FIG. 18 shows the analysis results regarding the steady states, each steady state being in response to each analysis condition. As shown in FIG. 18, in each analysis result in response to each analysis condition, the water surface temperature is not less than 0° C.; namely, the water located on the surface is not changed into ice. Further, as described above, the contour line of 0° C. means the boundary of the formed ice; when attention is paid to this contour line of each steady state analysis result, each 0° C. contour line can be approximately flat. However, when the contour lines of −9° C. are compared among the results for the three conditions (the first to third conditions), a considerable degree of ice surface unevenness can be recognized in the analysis result for the first condition. On the other hand, the −9° C. contour line for the second condition is flatter than that for the first condition; the −9° C. contour line for the third condition is flatter than that for the second condition. In this way, it is understood that the structure in response to the first condition is inclined to bring the unevenness regarding the ice surface.

In the next place, the results regarding a non-steady state analysis are explained. As described above, in the non-steady state analysis, a study is executed on the analyzed temperature distribution at a time point when the water temperature at the level whose height is 30 mm below the water surface becomes approximately −2° C. on the rightmost or leftmost side of the analysis region. Incidentally, in the second and third condition, the height level 30 mm below the water surface means the height level of the boundary surface between the water layer and the concrete layer The height difference between the highest location point on the 0° C. contour line and the lowest location point on the 0° C. contour line is studied for the temperature distribution result regarding each condition; and, the height differences for the first, second and third conditions are compared.

FIG. 19 shows the analysis study results regarding the unevenness heights, each unevenness height being in response to each analysis condition; each height difference corresponds to the unevenness of the ice surface. Incidentally, the 0° C. contour line is a boundary below which ice is formed.

FIG. 20 shows the analysis results (the temperature distribution results), each analysis result being in response to each analysis condition.

The matters found based on the results of the analysis are:

the unevenness height of the ice for the third condition is lower than that for the second condition; and, the unevenness height of the ice for the second condition is lower than that for the first condition.

The reason for the above can be considered that, when the heat conductivity of the member located above the cooling pipe is high, heat can be uniformly diffused; in particular, in the case of the third condition under which the cooling pipe structure is provided with the punching metal, the water (ice) above the cooling pipe can be uniformly cooled. Accordingly, it is revealed that the ice board with flat surface can be formed, when the cooling pipe structure according to this first configuration example is adopted.

In addition, in the cooling pipe structure according to the second configuration example of this mode, the cooling pipe is the cooling pipe with micro-channel structure; the cooling pipe structure according to the second configuration example as efficiently works as that according to the first example. Hence, also according to the second configuration example, the ice board with flat surface can be formed.

Second Application Example

In a second application example, a thermal analysis for a curling-use ice rink provided with the cooling facility according to the present mode is performed, so that the influence of the cooling pipe structure under the conditions regarding the ice board is verified. Incidentally, in performing the thermal analysis, a fluid-flow and heat-transfer analysis software application SCRYU/Tetra for Windows Version8 (developed by Software Cradle Co., Ltd.) is made use of.

Further, in the thermal analysis, the cooling pipe structure of the first configuration example shown in FIGS. 4(A), 4(B-1) and 4(B-2) is used (as an analysis model), in similar to the above-described first application example; thereby, the cooling pipes are copper pipes, and the planar heat conduction member is the punching metal plate made from aluminum.

FIG. 21 shows the outline of the analysis model. On the left side of the drawing (FIG. 21), the analysis model for a first condition is shown; on the right side of the drawing (FIG. 21), the enlarged analysis model for a fourth condition and the enlarged analysis model for a fifth condition are shown. In each of the fourth and fifth conditions of the present second application example, the punching metal plate construction condition is included.

When the punching metal plate is placed in the sand-and-water layer in the first condition, the first condition is changed into the fourth condition (i.e. the definition of the fourth condition). Further, when the cooling pipe distance of 100 mm in the fourth condition is changed into the doubled distance of 200 mm, the fourth condition is changed into the fifth condition (i.e. the definition of the fifth condition). Accordingly, the width of the modeled analysis region in response to the fifth condition is extended into 200 mm, whereas the width of the modeled analysis region in response to the fourth condition remains 100 mm. Also, in the analysis using the fourth or fifth condition, the analysis object is modeled as a substantially 2-dimensional model (an artificially 2-dimensional model); and, the shape and the aspect regarding any cross-section in the depth direction is supposed to be unchanged. In other words, the performed analysis is a computer analysis in which the thickness in the depth direction is disregarded.

FIG. 22 shows a table of the analysis conditions. As shown in FIG. 22, as the parameters of the analysis conditions, the room temperature, the underground temperature and the cooling pipe temperature are set at 15° C., 10° C. and −12° C., respectively.

FIG. 23 shows a table that describes the heat conductivity of each layer. As described above, in the treatment of the punching metal plate and the heat conductivity thereof for the first to third conditions, it is hypothesized that there is no hole above the cooling pipe in the 50 mm width range (from the −25 mm left side point to the 25 mm right side point); and, the holes are placed in both the end side 25 mm width ranges (from the −50 mm left side point to the −25 mm left side point, as well as, from the 25 mm right side point to the 50 mm right side point). It is further hypothesized that the heat conductivity regarding the punching metal plate-part where there is no hole is to be the same as the heat conductivity of aluminum; and, the heat conductivity regarding the punching metal plate-part where there is the hole is to be the same as the heat conductivity of concrete, as the hole is fulfilled with concrete. Further, in a case where the open area ratio is different from the above-described 50%, the heat conductivity of the punching metal plate is determined in response to the open area ratio in addition to the aluminum heat conductivity and the concrete heat conductivity. Also, in relation to the treatment of the punching metal plate and the heat conductivity thereof for the fourth and fifth conditions, the heat conductivity of the punching metal plate is determined in response to the open area ratio in addition to the aluminum heat conductivity and the concrete heat conductivity.

In the analysis model, the most upper layer is to be a water layer (or an ice layer); however, different from ice, the upper surface of water cannot rise up. Accordingly, it is hypothesized, also due to the limitations from the used software, that the level of the water surface is always constant. As a result, the 0° C. contour line, which is the boundary where ice begins being formed in the water (or the ice layer), distributes flat as time passes. Hence, in performing the analysis, in addition to the steady state analysis, the transient change regarding the temperature distribution (2-dimensional distribution over the modeled area) is followed up (i.e. non-steady state analysis is performed) in order to evaluate the unevenness regarding the surface of the ice to be formed (as is the case with the first application example), as well as, in order to make sure which model (analysis model) shows the most rapid cooling speed. To be more specific, a study is executed on the analyzed temperature distribution and the temperature (distribution) transition; the elapse time points when the temperature of the rightmost or the leftmost point on the (upper) surface of the water (ice) layer reaches −4° C. are compared. Thereby, it is presumed that the ice board height is lowest at the rightmost or the leftmost point on the (upper) surface of the water (ice) layer; the rightmost or the leftmost point is on the longitudinal line on the right or left side end of the modeled analysis region. In the case of the first or fourth condition, the width of the modeled analysis region is 100 mm; in the case of the fifth condition, the width of the modeled analysis region is 200 mm.

The analysis results are shown as follows.

FIGS. 24, 25 and 26 show the analysis results regarding the steady states, each steady state being in response to each analysis condition (i.e. the condition 1, 4 or 5 respectively). As shown in FIGS. 24, 25 and 26, it can be confirmed that the analysis result in response to the fourth condition shows the most cooled temperature distribution (e.g. on the surface of the ice); and, the temperature distribution in response to the first condition is almost the same as the temperature distribution in response to the fifth condition.

In the next place, the results regarding the non-steady analysis are compared; namely, a study is executed on the analyzed temperature distribution at a time point when the water temperature on the leftmost or rightmost line of the modeled region at the level whose height is 30 mm below the water surface becomes approximately −2° C. Incidentally, the level whose height is 30 mm below the water surface means the level whose height is 10 mm above bottom of the water (ice) later; further, a lowest temperature point on a contour line regarding a temperature is located on the leftmost or rightmost line of the modeled region.

The height difference between the highest location point on the 0° C. contour line and the lowest location point on the 0° C. contour line is studied for the temperature distribution result regarding each condition; and, the height differences for the first, fourth and fifth conditions are compared. FIG. 27 shows a table as to the analysis study results regarding the unevenness heights of the ice surface. In addition, the 0° C. contour line is the boundary where the ice begins being formed. FIG. 28 shows the analysis result in response to the first condition.

On the basis of the table of FIG. 27, it is confirmed that the height unevenness of the ice surface under the fourth condition is greater than that under the fifth condition; and, the height unevenness of the ice surface under the fifth condition is greater than that under the first condition.

Further, in the non-steady analysis, a study is executed on how long it takes the temperature at the upper ice surface on the leftmost or rightmost line of the modeled region to reach −4° C., for each condition. And, the required time spans for three conditions are compared; FIG. 29 shows the comparison results regarding the time spans. It is confirmed that the required time span under the fourth condition is shorter than that under the first condition; the required time span under the first condition is shorter than that under the fifth condition.

The matters found based on the results of the analysis are:

the height unevenness regarding the ice board surface is hard to be produced firstly under the fourth condition, secondary under the fifth condition, and thirdly under the first condition; and, the ice board is rapidly formed firstly under the fourth condition, secondary under the fourth condition, and under the fifth condition.

As described, the fourth condition is the most preferable condition; the reason is that the higher the heat conductivity of the member placed on and over the cooling pipe, the faster and the more uniformly heat diffuses. Further, even when the distance between the cooling pipes is doubled, the cooling speed in the case where the punching metal plate is provided can be the same level as the cooling speed in the case where the punching metal is not provided (i.e. in the case of the first condition).

In addition, the cooling pipe according to the second configuration example of the present mode provided with micro-channel structure so that the cooling pipe according to the second configuration works almost as is the case with the first configuration example. Accordingly, even when the distance of the cooling pipes according to the second configuration example is enlarged, the cooling speed can be maintained at a high level.

The items with the numerals or alpha-numerals in the figures or this specification are explained as follows:

1 a cooling-pipe bank;
1A a cooling-pipe bank;
1B a cooling-tube bank;
2 a refrigerating device;
3 a $CO_2$ circulation circuit;
3A a $CO_2$ feed line;
3B a $CO_2$ return line;
10 an ice rink;
11 a cooling pipe;
11A a cooling pipe;
11B a cooling pipe;
16 a planar heat conduction member;
17 a pressing plate;
18 a tying member;
20 a $CO_2$ receiver;
21 a first re-liquefaction line;
21*a* a first re-liquefaction branch line;
21*b* a first re-liquefaction return line;
22 a second re-liquefaction line;
22*a* a second re-liquefaction branch line
22*b* a second re-liquefaction return line;
23 a main re-liquefaction feed line;
24 a three-way valve;
25 a control means;
28 a $CO_2$ re-liquefaction refrigerator;
60 a header structure;
61 a feed-side sub-header;
65 a return-side sub-header
70 a header structure;
71 a feed-side sub-header;
75 a return-side sub-header;
81 a feed-side main-header;
82 a return-side main-header;
211 a cascade condenser;
221 an air-cooling type $CO_2$ re-liquefaction device.

What is claimed is:

1. An ice rink cooling facility:

a cooling passage pipe bank comprising a plurality of cooling passage pipes is arranged at the bottom part of the ice rink and $CO_2$ brine streams through the passages of the cooling passage pipe bank so as to cool the ice rink, wherein the cooling-passage pipe bank is arranged at the bottom part of the ice rink, the straight line part of each cooling cooling-passage pipe being parallel to the straight part of the adjacent cooling-passage pipe;

an ammonia refrigerating cycle in which an ammonia refrigerant circulates; and a cascade condenser in which the heat exchange is performed between the $CO_2$ brine and the ammonia refrigerant so that the $CO_2$ brine is cooled and re-liquefied by use of the ammonia refrigerant, wherein the ammonia refrigerating cycle comprises:

a main refrigerator that is used for manufacturing the ice for the ice rink;

an auxiliary refrigerator that is connected to the main refrigerator in parallel and used for preventing the pressure of the $CO_2$ brine from increasing; and wherein the main refrigerator is operated when the ice of the ice rink is formed, whereas the auxiliary refrigerator is operated instead of the main refrigerator except when the ice of the ice rink is formed.

2. The ice rink cooling facility according to claim 1, wherein the auxiliary refrigerator is an air-cooling type $CO_2$ re-liquefaction device that cools the $CO_2$ brine by use of the outdoor air.

3. The ice rink cooling facility according to claim 1, wherein at least one planar heat conduction member is arranged on and over the cooling-passage pipes;

wherein the planar heat conduction member is configured with the upper sidewall of the cooling-passage pipe, the upper sidewall being formed in a flat planar shape; and wherein the planar heat conduction member is configured along the flat planar sidewall.

4. The ice rink cooling facility according to claim 3, wherein the cooling-passage pipe whose upper sidewall forms the planar heat conduction member comprises a plurality of bored holes provided in parallel to each other along the flat planar sidewall in the longitudinal direction, the drilled hole having the cross-section of a circular shape, a square shape or a slit shape.

5. The ice rink cooling facility according to claim 3, wherein the planar heat conduction member is configured with the upper sidewall of the cooling-passage pipe, the upper sidewall being formed in a flat planar shape and the cooling pipe comprises a plurality of microscopic passages through which the $CO_2$ brine streams.

6. The ice rink cooling facility according to claim 1, wherein a plurality of heating pipes are constructed in the under-floor ground under the bottom of part of the ice rink, the cooling-passage pipe bank being constructed at the bottom part.

7. The ice rink cooling facility according to claim 2, the facility comprising:

at least one sub-header to which a plurality of cooling-passage pipe is connected and at least one main header to which a plurality of sub-headers is connected, wherein the cooling-passage pipe are connected to the $CO_2$ circulation circuit via the sub-headers and the main header.

8. The ice rink cooling facility according to claim 1, comprising:

an air duct at least along the circumference of the ice rink, wherein the cooling air fed through the air duct is spouted upward from the air duct so as to form an air curtain.

9. An ice rink cooling facility comprising:

a cooling passage pipe bank comprising a plurality of cooling passage pipes is arranged at the bottom part of the ice rink and $CO_2$ brine streams through the passages of the cooling passage pipe bank so as to cool the ice rink, wherein the cooling-passage pipe bank is arranged at the bottom part of the ice rink, the straight line part of each cooling cooling-passage pipe being parallel to the straight part of the adjacent cooling-passage pipe;

an ammonia refrigerating cycle in which an ammonia refrigerant circulates;

a cascade condenser in which the heat exchange is performed between the $CO_2$ brine and the ammonia refrigerant so that the $CO_2$ brine is cooled and re-liquefied by use of the ammonia refrigerant;

a first re-liquefaction line that comprises the ammonia refrigerating cycle and a second re-liquefaction line that comprises air cooling type $CO_2$ re-liquefaction device are connected in parallel; and a three-way valve is provided so that the first re-liquefaction line and the second re-liquefaction line is selectively changed over into each other, by use of the three-way valve;

wherein the ammonia refrigerating cycle comprises:

a main refrigerator that is used for manufacturing the ice for the ice rink; and an auxiliary refrigerator that is connected to the main refrigerator in parallel and used for preventing the pressure of the $CO_2$ brine from increasing;

wherein the main refrigerator is operated when the ice of the ice rink is formed, whereas the auxiliary refrigerator is operated instead of the main refrigerator except when the ice of the ice rink is formed; and wherein the auxiliary refrigerator is an air-cooling type $CO_2$ re-liquefaction device that cools the $CO_2$ brine by use of the outdoor air.

10. An ice rink cooling facility:

a cooling passage pipe bank comprising a plurality of cooling passage pipes is arranged at the bottom part of the ice rink and $CO_2$ brine streams through the passages of the cooling passage pipe bank so as to cool the ice rink, wherein in the cooling-passage pipe bank arranged at the bottom part of the ice rink, the straight line part of each cooling cooling-passage pipe being parallel to the straight part of the adjacent cooling-passage pipe;

a planar heat conduction member that is arranged at least on and over the adjacent cooling-passage pipes;

at least one feed header and at least one return header so that the fluid flow through the cooling-passage pipes streams in one way from a feed header to a return header, or to-and-fro from a feed header to a return header;

a $CO_2$ circulation circuit that is connected to the cooling passage pipes via the feed header and the return header;

an ammonia refrigerating cycle in which an ammonia refrigerant circulates; and a cascade condenser in which the heat exchange is performed between the $CO_2$ brine and the ammonia refrigerant so that the $CO_2$ brine is cooled and re-liquefied by use of the ammonia refrigerant, wherein the ammonia refrigerating cycle comprises:

a main refrigerator that is used for manufacturing the ice for the ice rink; and an auxiliary refrigerator that is connected to the main refrigerator in parallel and used for preventing the pressure of the $CO_2$ brine from increasing; and wherein the main refrigerator is operated when the ice of the ice rink is formed, whereas the auxiliary refrigerator is operated instead of the main refrigerator except when the ice of the ice rink is formed;

wherein the planar heat conduction member is placed on and over the cooling passage pipes so that the planar heat conduction member comes into contact with the upper surface of the corresponding passage pipes or with the upper sidewall of the corresponding passages, the planar heat conduction member and the cooling-passage pipes working as an integrated body in view of heat conductivity.

11. The ice rink cooling facility according to claim 10, wherein the cooling-passage pipe is a cooling pipe, an opening end of the cooling pipe being connected to one header or multiple headers, the planar heat conduction member is configured as a member that is different from the cooling pipe and the planar heat conduction member is arranged on and over the upper surface of the cooling-pipes so that the planar heat conduction member comes in contact with the cooling-pipes, the planar heat conduction member comprises a plurality of opening holes in a range between a cooling-pipe and the adjacent cooling-pipe.

12. The ice rink cooling facility according to claim 10, wherein the planar heat conduction member is a punching metal plate comprising a plurality of holes that are scattered over the punching metal plate;

the planar heat conduction member is supported by the cooling pipes is such a manner that a pressing plate presses the planar heat conduction member toward the upper surface of the cooling pipes and the pressing plate ties the planar heat conduction member and the upper surface of the cooling pipes.

13. The ice rink cooling facility according to claim 12, wherein the pressing plate has the opening holes, the diameter of each opening hole being larger than the diameter of the opening hole of the planar heat conduction member;

the opening hole of the pressing plate is located over the opening hole of planar heat conduction member so that the diameter regarding the opening hole of the pressing plate is larger than the diameter regarding the opening hole of planar heat conduction member and the pressing plate is tied to the cooling pipes so that the planar heat conduction member is held between the pressing plate and the cooling pipes, and the planar heat conduction member is pressed toward the cooling pipes.

* * * * *